US009083122B2

(12) United States Patent
Beak et al.

(10) Patent No.: US 9,083,122 B2
(45) Date of Patent: Jul. 14, 2015

(54) CONNECTOR UNIT AND CONNECTOR

(75) Inventors: SeungSeok Beak, Tokyo (JP); Koichi Kiryu, Nagano (JP); Keiichi Hirose, Tokyo (JP); Tomonori Iino, Tokyo (JP)

(73) Assignees: FUJITSU COMPONENT LIMITED, Tokyo (JP); NTT FACILITIES, INC., Tokyo (JP)

( * ) Notice: Subject to any disclaimer, the term of this patent is extended or adjusted under 35 U.S.C. 154(b) by 557 days.

(21) Appl. No.: 13/579,663

(22) PCT Filed: Feb. 21, 2011

(86) PCT No.: PCT/JP2011/053747
§ 371 (c)(1),
(2), (4) Date: Oct. 22, 2012

(87) PCT Pub. No.: WO2011/102516
PCT Pub. Date: Aug. 25, 2011

(65) Prior Publication Data

US 2013/0199903 A1 Aug. 8, 2013

(30) Foreign Application Priority Data

Feb. 19, 2010 (JP) ..... 2010-035345

(51) Int. Cl.

| | |
|---|---|
| ***H01R 13/70*** | (2006.01) |
| ***H01R 13/707*** | (2006.01) |
| ***H01R 24/78*** | (2011.01) |
| *H01H 31/10* | (2006.01) |
| *H01R 103/00* | (2006.01) |

(52) U.S. Cl.
CPC ..... *H01R 13/70* (2013.01); *H01R 13/707* (2013.01); *H01R 24/78* (2013.01); *H01R 2103/00* (2013.01)

(58) Field of Classification Search
USPC ..... 307/115
See application file for complete search history.

(56) References Cited

U.S. PATENT DOCUMENTS

| | | | |
|---|---|---|---|
| 5,635,690 | A | 6/1997 | Knecht et al. |
| 5,921,794 | A | 7/1999 | Koch |
| 7,982,145 | B2 | 7/2011 | Yuba |
| 2010/0029141 | A1 | 2/2010 | Nakamura et al. |

FOREIGN PATENT DOCUMENTS

| | | |
|---|---|---|
| CN | 101640348 | 2/2010 |
| EP | 2149939 | 2/2010 |

(Continued)

OTHER PUBLICATIONS

International Search Report mailed on Mar. 15, 2011.

*Primary Examiner* — Robert Deberadinis
(74) *Attorney, Agent, or Firm* — Ipusa, PLLC

(57) ABSTRACT

A connector unit includes a first connector configured to be connected to an electrical apparatus, the first connector including multiple power receiving terminals for receiving a supply of electric power; and a second connector configured to be connected to a direct-current power supply and mated with the first connector. The second connector includes multiple power feeding terminals corresponding to the power receiving terminals of the first connector and a switch member configured to be moved between a connecting position for electrically connecting the power feeding terminals and the direct-current power supply and a breaking position for breaking the connection of the power feeding terminals and the direct-current power supply.

27 Claims, 25 Drawing Sheets

(56) References Cited

FOREIGN PATENT DOCUMENTS

| | | | |
|---|---|---|---|
| JP | 57-125118 U | 8/1982 | |
| JP | 62-193070 | 8/1987 | |
| JP | 64-020515 | 1/1989 | |
| JP | 05-082208 | 4/1993 | |
| JP | 2001-517862 | 10/2001 | |
| JP | 2003-031301 | 1/2003 | |
| JP | 2010-033967 | 2/2010 | |

CONNECTOR UNIT AND CONNECTOR

TECHNICAL FIELD

The present invention relates to a connector unit and a connector used to supply electric power from a power supply to an electrical apparatus.

BACKGROUND ART

Generally, electrical apparatuses operate with electric power supplied from a power supply. Thus, in receiving electric power from a power supply, usually, the electric power is supplied from the power supply to an electrical apparatus via a connector unit. The connector unit used in this case establishes electrical connection by mating a plug connector and a jack connector as disclosed in Patent Documents 1 and 2.

On the other hand, in recent years, studies have been made, as a measure against global warming, of supplying direct-current, high-voltage electric power in power transmission in local areas as well. Such a form of power supply, which is reduced in power loss in voltage conversion or power transmission and does not require an increase in cable thickness, is considered desirable particularly for electrical apparatuses such as servers, which consume a large amount of electric power.

In the case of using such high-voltage electric power for electrical apparatuses such as servers, connector units, where electrical connection is established, need to be different from those used for usual alternating-current commercial power supplies.

PRIOR-ART DOCUMENTS

Patent Documents

[Patent Document 1] Japanese Laid-Open Patent Application No. 5-82208

[Patent Document 2] Japanese Laid-Open Patent Application No. 2003-31301

SUMMARY OF THE INVENTION

Problems to be Solved by the Invention

The present invention is made in view of the above-described point, and has an object of providing a connector unit and a connector suitable for supplying electric power.

Means for Solving the Problems

According to one aspect of the present invention, a connector unit includes a first connector configured to be connected to an electrical apparatus, the first connector including a plurality of power receiving terminals for receiving a supply of electric power; and a second connector configured to be connected to a direct-current power supply and mated with the first connector, the second connector including a plurality of power feeding terminals corresponding to the power receiving terminals of the first connector; and a switch member configured to be moved between a connecting position for electrically connecting the power feeding terminals and the direct-current power supply and a breaking position for breaking a connection of the power feeding terminals and the direct-current power supply.

According to one aspect of the present invention, a connector unit includes a first connector configured to be connected to an electrical apparatus, the first connector including a plurality of power receiving terminals for receiving a supply of electric power; and a second connector configured to be connected to a power supply and mated with the first connector, the second connector including a plurality of power feeding terminals corresponding to the power receiving terminals of the first connector; a switch member configured to be moved between a connecting position for electrically connecting the power feeding terminals and the power supply and a breaking position for breaking a connection of the power feeding terminals and the power supply; and a controlling mechanism configured to prevent a movement of the switch member from the breaking position to the connecting position before a mating of the first connector and the second connector.

According to one aspect of the present invention, a connector, configured to be connected to a power supply and mated with an apparatus-side connector configured to be connected to an electrical apparatus, includes a plurality of power feeding terminals corresponding to a plurality of power receiving terminals of the apparatus-side connector for receiving a supply of electric power; and a switch member configured to be moved between a connecting position for electrically connecting the power feeding terminals and the power supply and a breaking position for breaking a connection of the power feeding terminals and the power supply, wherein the power supply is a direct-current power supply.

According to one aspect of the present invention, a connector, configured to be connected to a power supply and mated with an apparatus-side connector configured to be connected to an electrical apparatus, includes a plurality of power feeding terminals corresponding to a plurality of power receiving terminals of the apparatus-side connector for receiving a supply of electric power; a switch member configured to be moved between a connecting position for electrically connecting the power feeding terminals and the power supply and a breaking position for breaking a connection of the power feeding terminals and the power supply; and a controlling mechanism configured to prevent a movement of the switch member from the breaking position to the connecting position before a mating of the connector and the apparatus-side connector.

Effects of the Invention

According to one aspect of the present invention, a connector unit and a connector are provided that are suitable for supplying electric power.

BRIEF DESCRIPTION OF THE DRAWINGS

Other objects, features and advantages of the present invention will become more apparent from the following detailed description when read in conjunction with the accompanying drawings, in which.

DESCRIPTION OF EMBODIMENTS

First Embodiment

Figure 1:
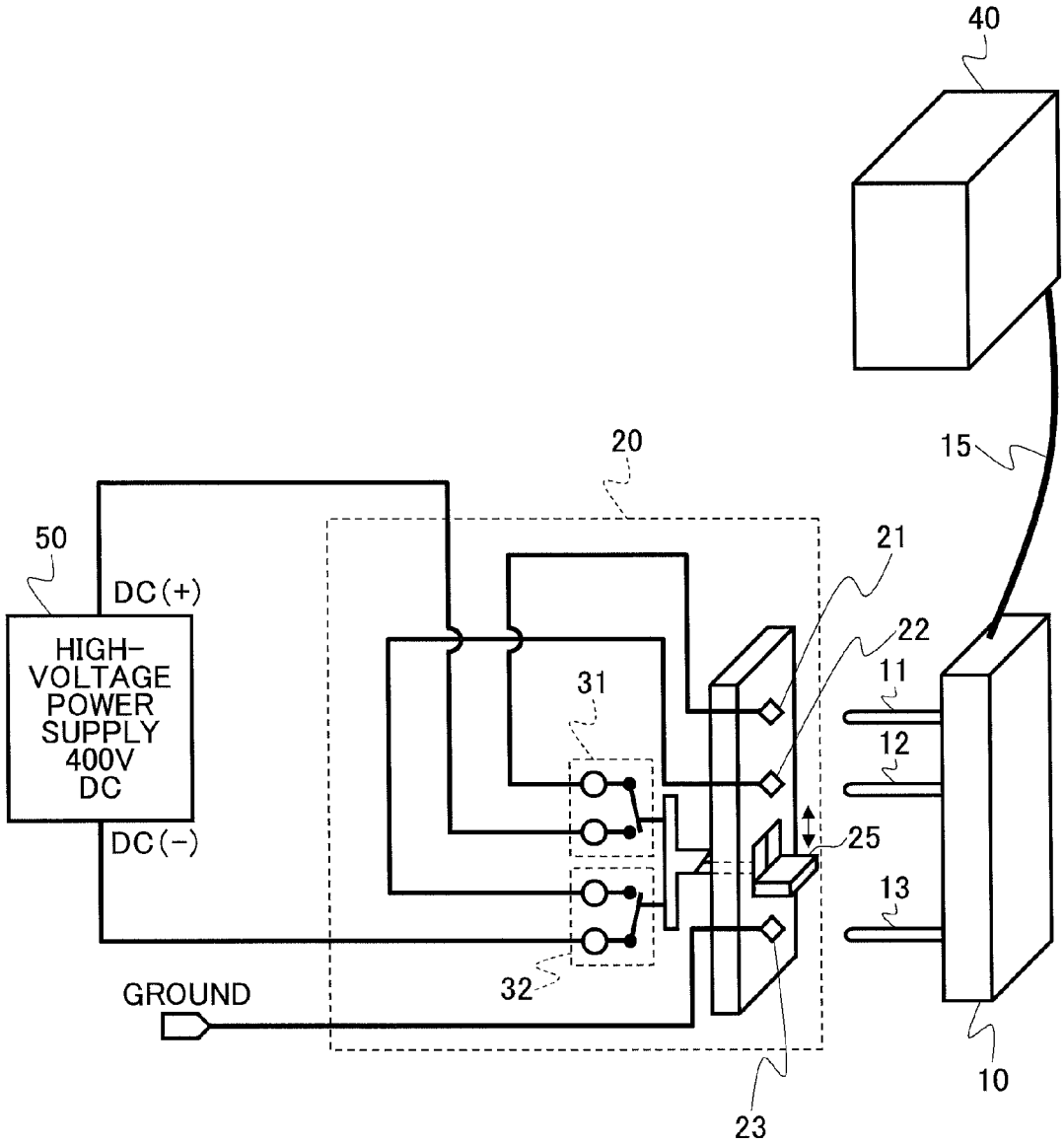
FIG. 1 is a diagram illustrating a configuration of a connector unit according to a first embodiment.

A description is given, with reference to the accompanying drawings, of a connector unit, an apparatus-side connector, and a power-supply-side connector according to a first embodiment. In the drawings, the X1-X2 directions, the Y1-Y2 directions, and the Z1-Z2 directions are perpendicular to one another.

Figure 2A:
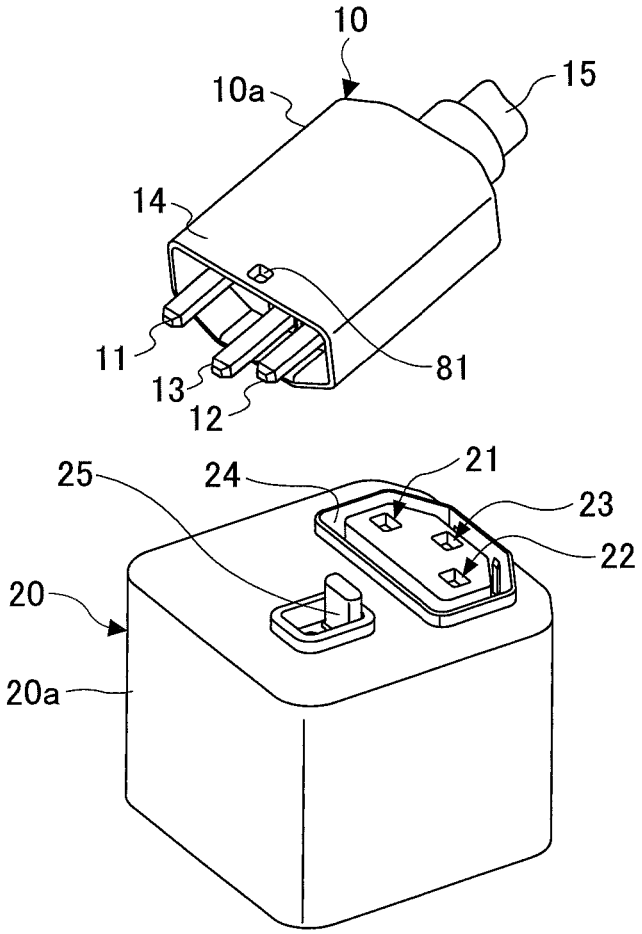
FIG. 2A is a perspective view of the exterior of an apparatus-side connector and a power-supply-side connector according to the first embodiment.
Figure 2B:
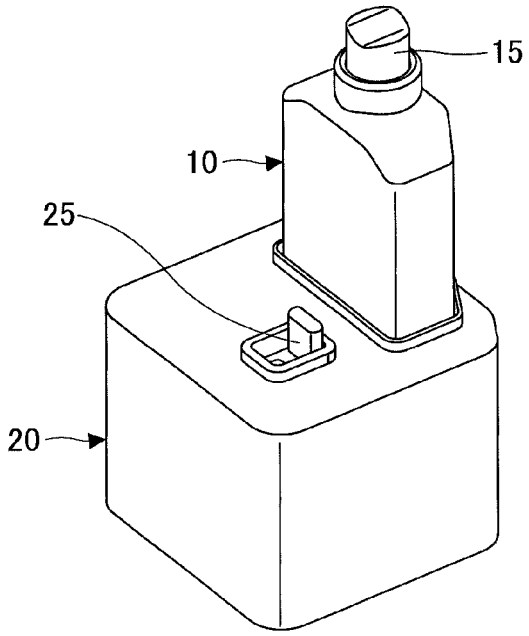
FIG. 2B is another perspective view of the exterior of the apparatus-side connector and the power-supply-side connector according to the first embodiment.
Figure 3A:
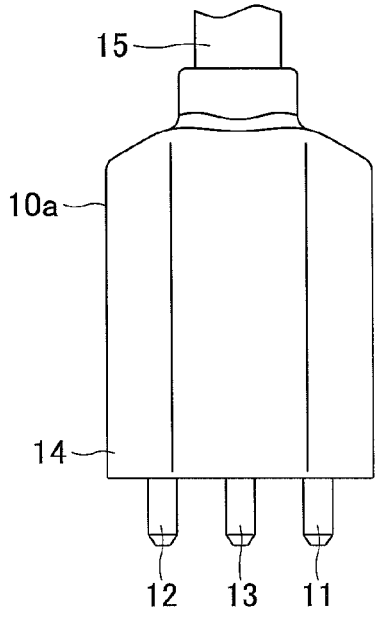
FIG. 3A is an outline drawing illustrating the apparatus-side connector according to the first embodiment.
Figure 3B:
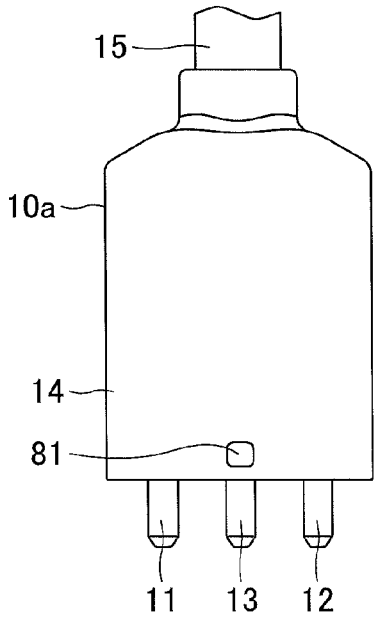
FIG. 3B is another outline drawing illustrating the apparatus-side connector according to the first embodiment.
Figure 3C:
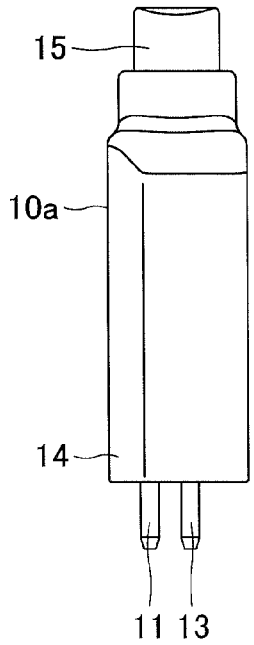
FIG. 3C is yet another outline drawing illustrating the apparatus-side connector according to the first embodiment.
Figure 3D:
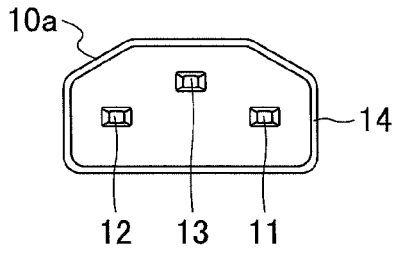
FIG. 3D is yet another outline drawing illustrating the apparatus-side connector according to the first embodiment.

First, an overview is given, with reference to FIG. 1 and FIGS. 2A and 2B, of the connector unit.

FIG. 1 is a diagram illustrating a configuration of the connector unit according to the first embodiment. FIGS. 2A and 2B are perspective views of the exterior of an apparatus-side connector 10 and a power-supply-side connector 20. FIG. 2A illustrates the apparatus-side connector 10 and the power-supply-side connector 20 in a separated state, and FIG. 2B illustrates the apparatus-side connector 10 and the power-supply-side connector 20 in a mated state.

The connector unit according to this embodiment includes the apparatus-side connector 10 and the power-supply-side connector 20, which are fittable to each other. Referring to FIG. 1, the apparatus-side connector 10 is connected to an electrical apparatus 40 such as a server via a power supply cable 15. The apparatus-side connector 10 includes two conductive power receiving terminals 11 and 12 for receiving a supply of electric power and a conductive grounding terminal 13 for grounding. Referring to FIG. 2A, an insulative housing 10*a* of the apparatus-side connector 10 includes a projecting part 14 at one end. The apparatus-side connector 10 is a plug connector, and the two power receiving terminals 11 and 12 and the grounding terminal 13 are plug terminals.

On the other side, referring to FIG. 1, the power-supply-side connector 20 is connected to a direct-current power supply 50. The power-supply-side connector 20 includes conductive power feeding terminals 21 and 22 corresponding to the power receiving terminals 11 and 12, respectively, and a conductive grounding terminal 23 corresponding to the grounding terminal 13. Referring to FIG. 2A, an insulative housing 20*a* of the power-supply-side connector 20 includes a recess 24 to which the projecting part 14 of the apparatus-side connector 10 is fittable. The power-supply-side connector 20 is a jack connector, and the two power feeding terminals 21 and 22 and the grounding terminal 23 are jack terminals.

Further, as illustrated in FIG. 1, the power-supply-side connector 20 includes a switch member 25 and two internal contact pairs 31 and 32. The switch member 25, which is an insulating member operable from outside the power-supply-side connector 20, is supported in a movable manner relative to the housing 20*a* of the power-supply-side connector 20. The switch member 25 is configured to be movable between a connecting position for electrically connecting the power feeding terminals 21 and 22 and the power supply 50 and a breaking position for breaking the connection. According to this embodiment, the switch member 25 is a slide type. However, the switch member 25 may also be a common switch such as a push, tilt, or rotary switch.

The internal contact pairs 31 and 32 are housed in the housing 20*a* of the power-supply-side connector 20, and are opened or closed in conjunction with the movement of the switch member 25. The internal contact pair 31 includes two terminals (contacts) capable of coming into contact with and separable from each other. One of the terminals is connected to the positive output of the power supply 50, and the other one of the terminals is connected to the power feeding terminal 21. Likewise, the internal contact pair 32 includes two terminals (contacts) capable of coming into contact with and separable from each other. One of the terminals is connected to the negative output of the power supply 50, and the other one of the terminals is connected to the power feeding terminal 22.

The internal contact pairs 31 and 32 are configured to be closed and establish connections (to have their respective terminals closed and connected) in response to a movement of the switch member 25 from the breaking position to the connecting position. In response to the internal contact pairs 31 and 32 being closed and establishing connections, the power supply 50 and the power feeding terminals 21 and 22 are electrically connected.

On the other hand, the internal contact pairs 31 and 32 are configured to be opened and break connections (to have their respective terminals opened and disconnected) in response to a movement of the switch member 25 from the connecting position to the breaking position. In response to the internal contact pairs 31 and 32 being opened and breaking connections, the power supply 50 and the power feeding terminals 21 and 22 are disconnected. This makes it possible to prevent an unintended supply of electric power from the power supply 50 to the power feeding terminals 21 and 22.

Next, a description is given of a method of using the connector unit configured as described above.

In the case of supplying electric power from the power supply 50 to the electrical apparatus 40, first, as illustrated in FIG. 2B, the power-supply-side connector 20 and the apparatus-side connector 10 are mated together. In this state, the power feeding terminal 21 and the power receiving terminal 11 are fit together, the power feeding terminal 22 and the power receiving terminal 12 are fit together, the grounding terminal 23 and the grounding terminal 13 are fit together, and the recess 24 and the projecting part 14 are fit together. Next, the switch member 25 is moved from the breaking position to the connecting position. Thereby, the internal contact pairs 31 and 32 are closed so that electric power is supplied from the power supply 50 to the power feeding terminals 21 and 22 and is further supplied to the electrical apparatus 40 via the power receiving terminals 11 and 12.

On the other hand, in the case of separating the apparatus-side connector 10 and the power-supply-side connector 20, first, the switch member 25 is moved from the connecting position to the breaking position. Thereby, the internal contact pairs 31 and 32 are opened so as to stop the supply of electric power from the power supply 50 to the electrical apparatus 40. Thereafter, as illustrated in FIG. 2A, the apparatus-side connector 10 and the power-supply-side connector 20 are separated. In this state, the power feeding terminals 21 and 22 and the power receiving terminals 11 and 12 are separated, the grounding terminal 23 and the grounding terminal 13 are separated, and the recess 24 and the projecting part 14 are separated.

According to this embodiment, the apparatus-side connector 10 is a plug connector and the power-supply-side connector 20 is a jack connector. Alternatively, the apparatus-side connector 10 may be a jack connector and the power-supply-side connector 20 may be a plug connector. That is, the two power receiving terminals 11 and 12 and the grounding terminal 13 may be jack terminals, and the two power feeding terminals 21 and 22 and the grounding terminal 23 may be plug terminals.

Next, a description is given, with reference to FIGS. 3A through 3D, of a structure of the apparatus-side connector 10. FIGS. 3A through 3D are outline drawings of the apparatus-side connector 10. FIGS. 3A, 3B, 3C, and 3D are a front view, a rear view, a side view, and a bottom view, respectively, of the apparatus-side connector 10.

As illustrated in FIGS. 3A through 3D, the power cable 15 is connected to the apparatus-side connector 10 on one side, and the power receiving terminals 11 and 12 and the grounding terminal 13 are provided in the apparatus-side connector on the other side.

Figure 4A:
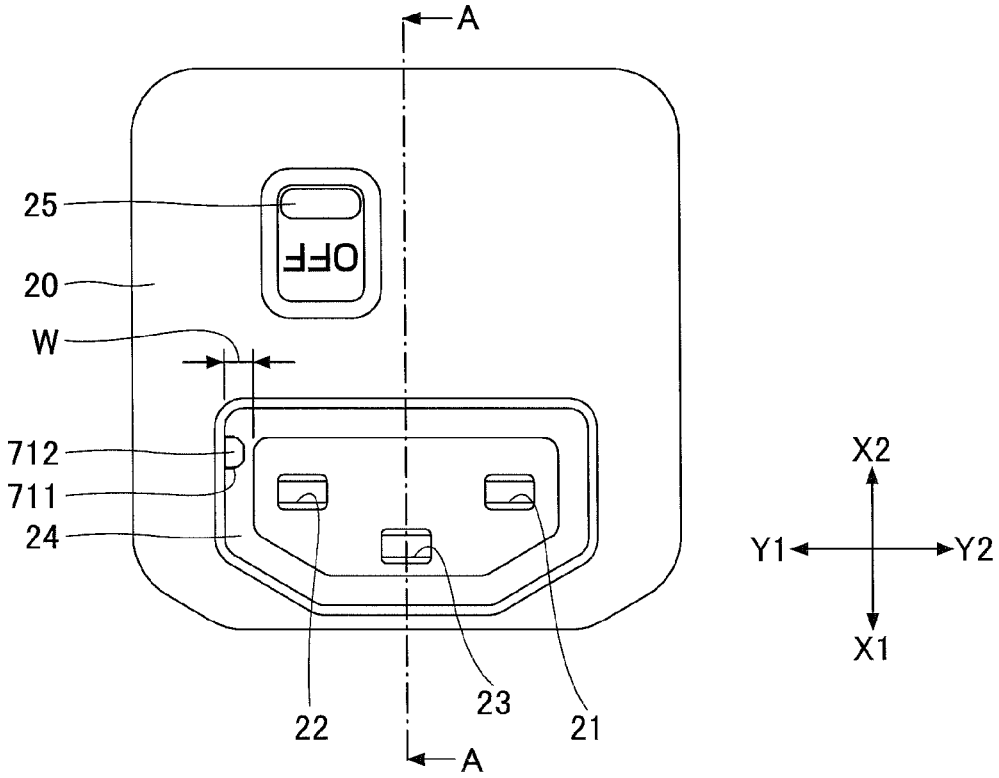
FIG. 4A is a plan view of the power-supply-side connector according to the first embodiment.
Figure 4B:
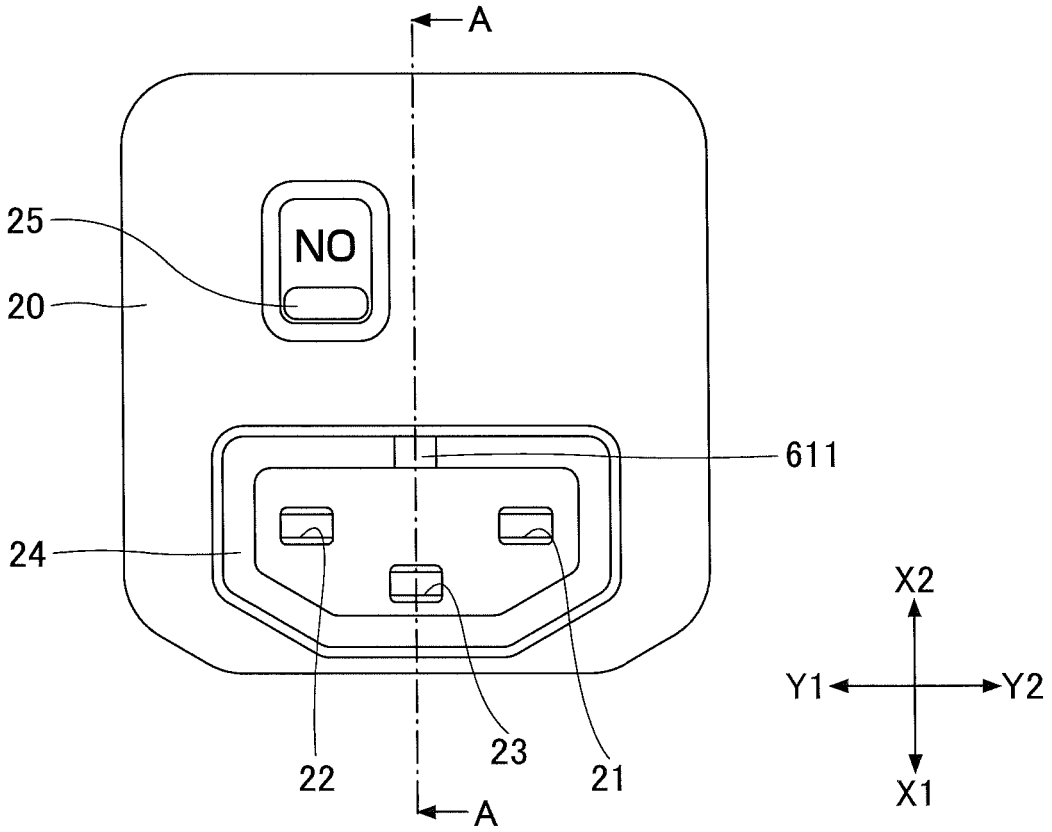
FIG. 4B is another plan view of the power-supply-side connector according to the first embodiment.
Figure 5A:
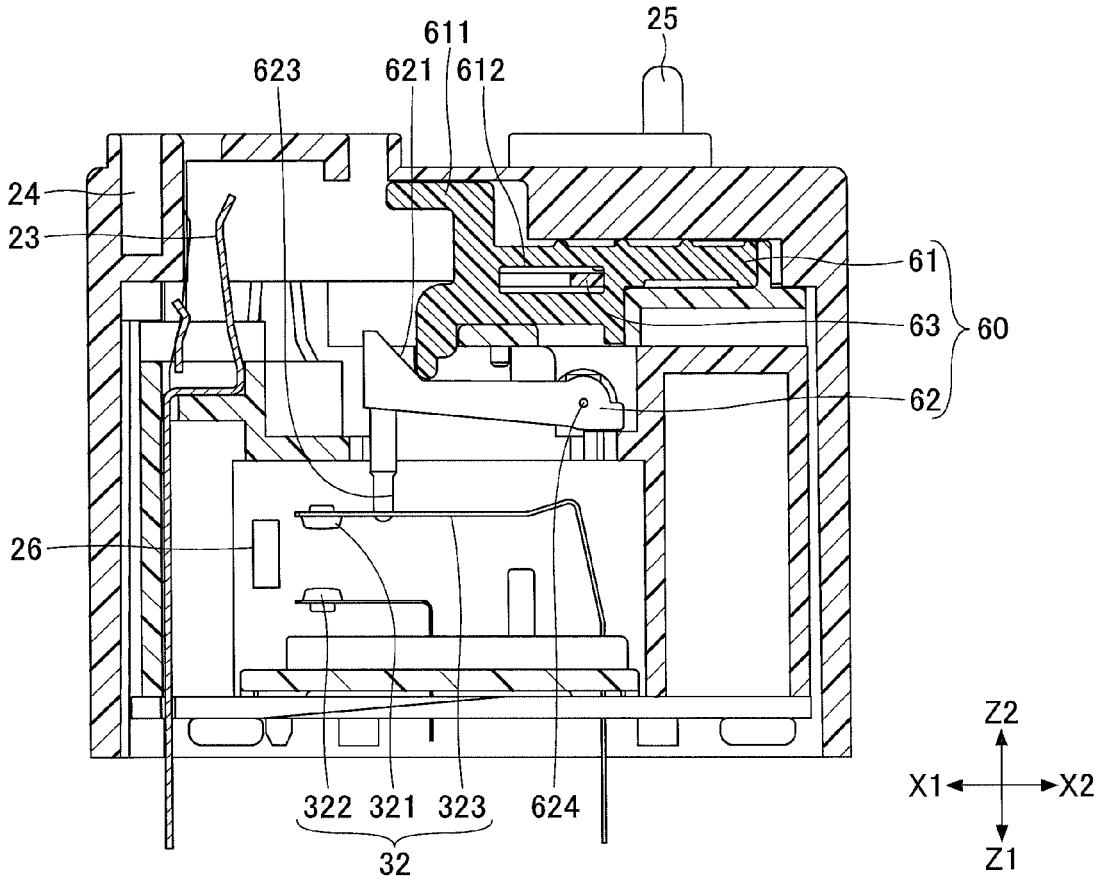
FIG. 5A is a cross-sectional view of the power-supply-side connector according to the first embodiment, taken along line A-A of FIG. 4A.
Figure 5B:
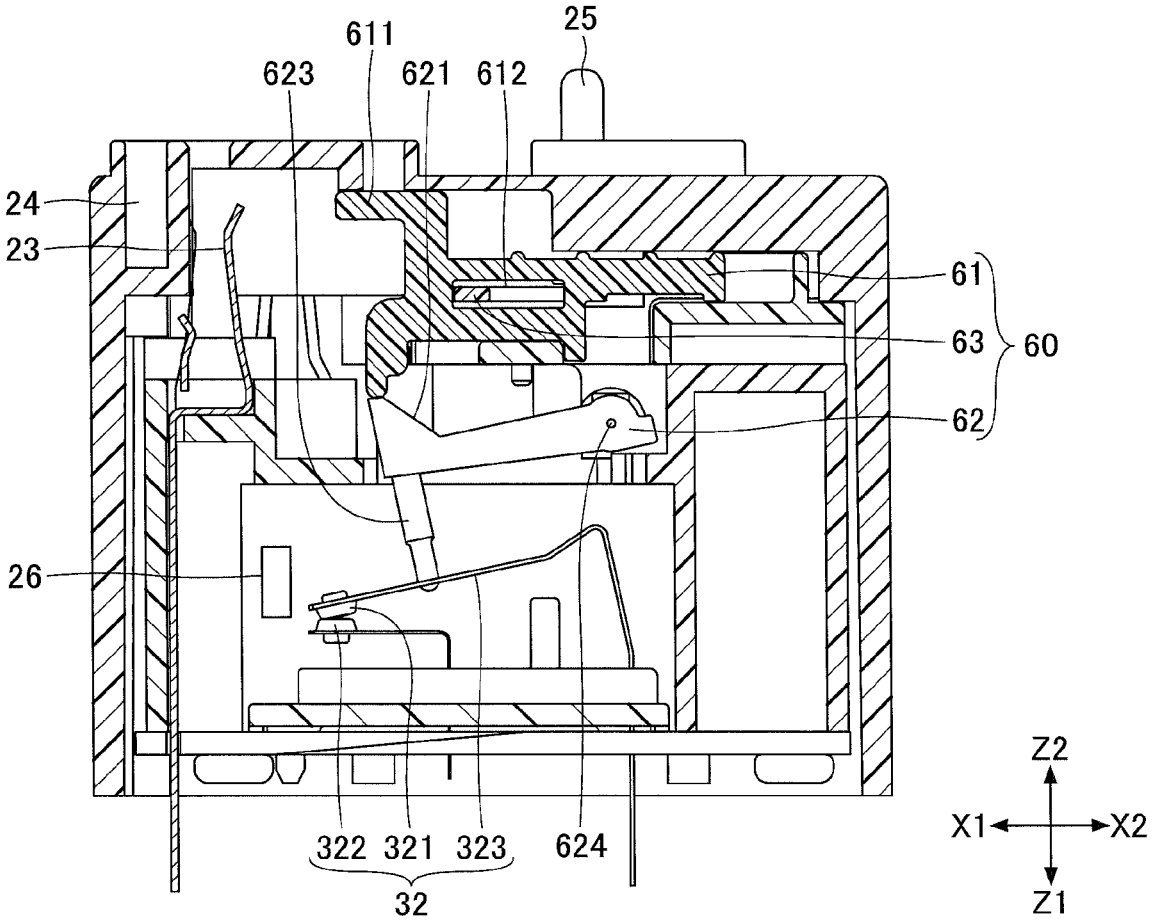
FIG. 5B is a cross-sectional view of the power-supply-side connector according to the first embodiment, taken along line A-A of FIG. 4B.
Figure 6:
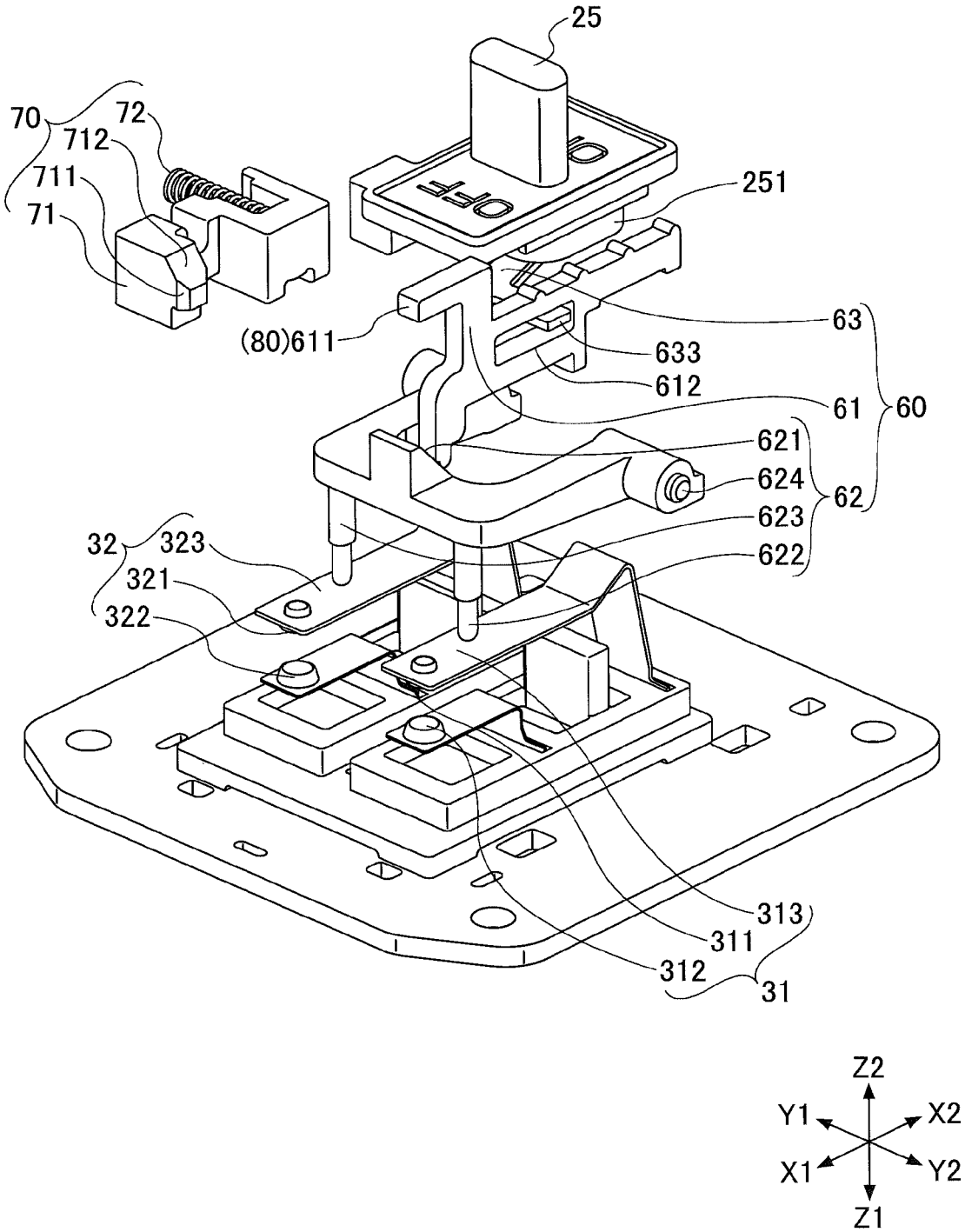
FIG. 6 is a perspective view of an internal structure of the power-supply-side connector according to the first embodiment.
Figure 7:
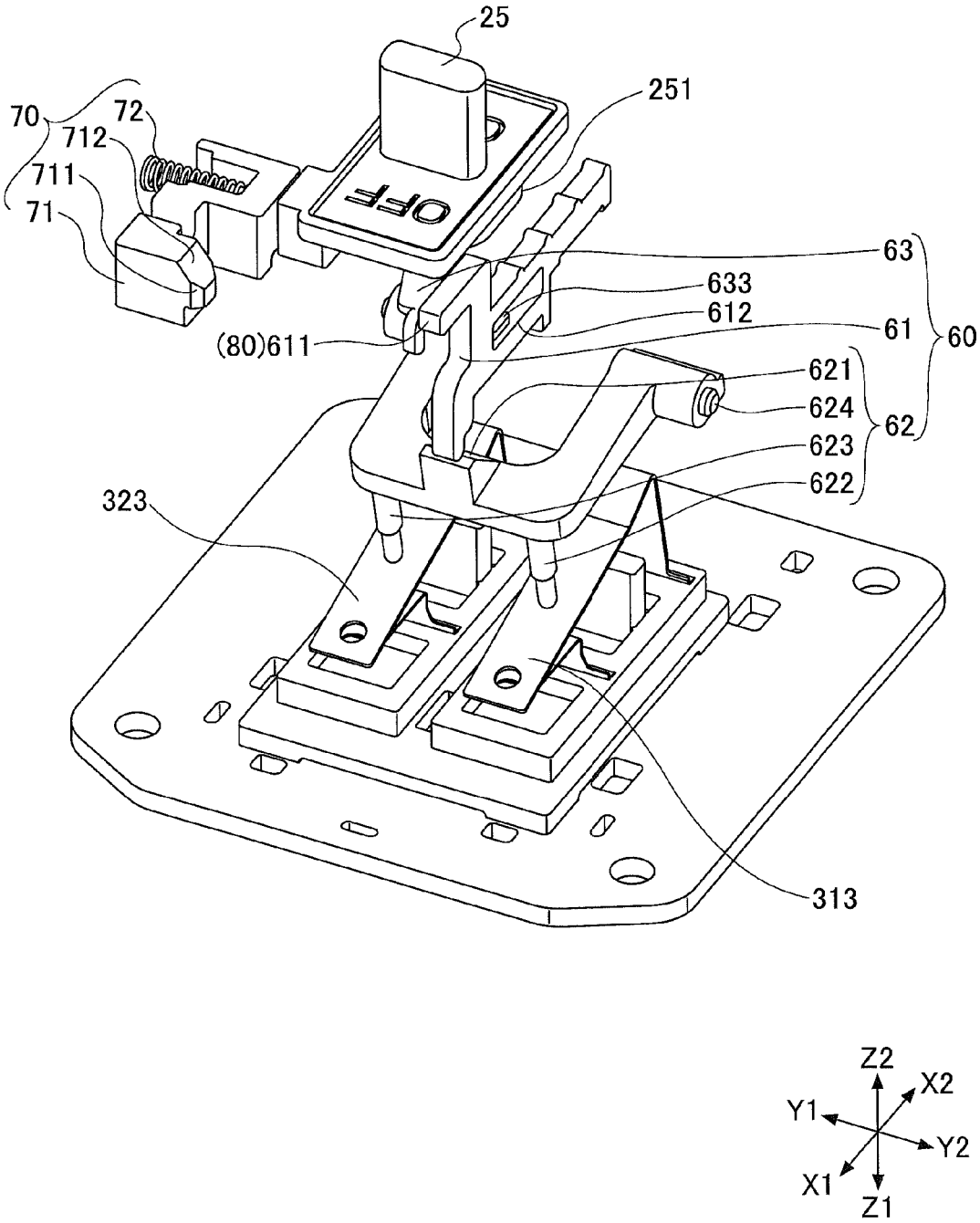
FIG. 7 is another perspective view of the internal structure of the power-supply-side connector according to the first embodiment.

Next, a description is given, with reference to FIG. 4A through FIG. 7, of a structure of the power-supply-side connector 20. FIGS. 4A and 4B are plan views of the power-supply-side connector 20, illustrating a state where the switch member 25 is in the breaking position and a state where the switch member 25 is in the connecting position, respectively. FIGS. 5A and 5B are cross-sectional views of the power-supply-side connector 20 taken along line A-A of FIGS. 4A and 4B, illustrating the state where the switch member 25 is in the breaking position and the state where the switch member 25 is in the connecting position, respectively. FIG. 6 is a perspective view of an internal structure of the power-supply-side connector 20, illustrating the state where the switch member 25 is in the breaking position. FIG. 7 is a perspective view of an internal structure of the power-supply-side connector 20, illustrating the state where the switch member 25 is in the connecting position.

As illustrated in FIG. 4A through FIG. 7, the power-supply-side connector 20 includes the conductive power feeding terminals 21 and 22, the conductive grounding terminal 23, the switch member 25, and the internal contact pairs 31 and 32. The internal contact pair 31 includes two terminals (contacts) 311 and 312 capable of coming into contact with and separable from each other. The terminal 311 is urged in a direction away from the other terminal 312. The power-supply-side connector 20 includes, for example, a metal leaf spring 313 as a member to urge the terminal 311. Likewise, the contact pair 32 includes two terminals (contacts) 321 and 322 capable of coming into contact with and separable from each other. The terminal 321 is urged in a direction away from the other terminal 322. The power-supply-side connector 20 includes, for example, a metal leaf spring 323 as a member to urge the terminal 321. The metal leaf springs 313 and 323 may be unitary.

Figure 9A:
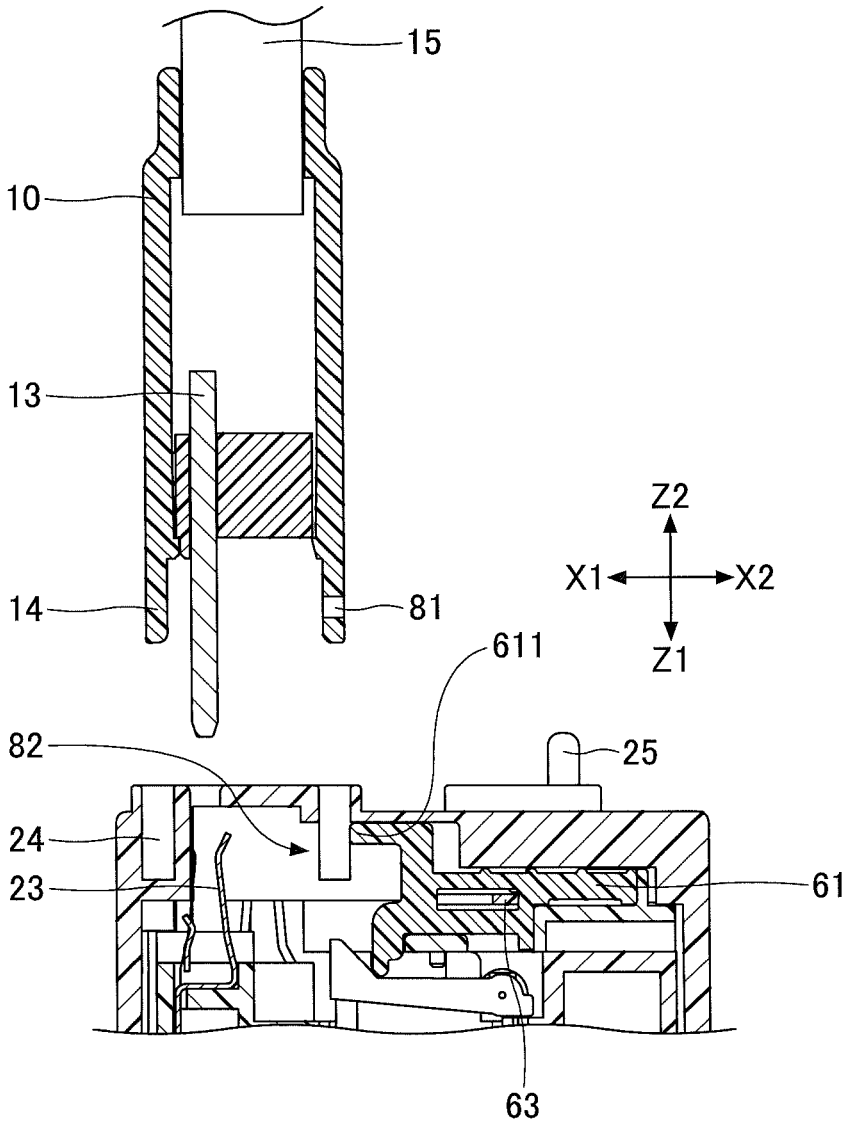
FIG. 9A is a diagram illustrating a controlling mechanism according to the first embodiment.
Figure 9B:
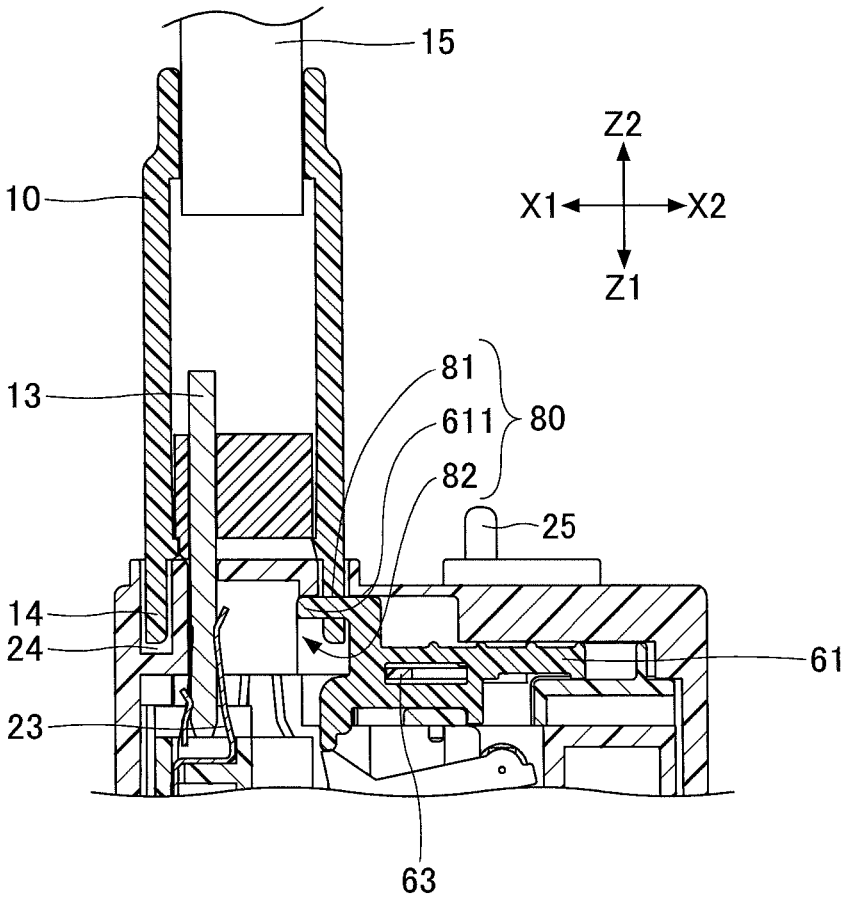
FIG. 9B is another diagram illustrating the controlling mechanism according to the first embodiment.

As illustrated in FIG. 6 and FIG. 7, the power-supply-side connector 20 includes an opening and closing mechanism 60, a controlling mechanism 70, and part of a restricting mechanism 80 (see FIGS. 9A and 9B). The opening and closing mechanism 60 is a mechanism configured to open or close the internal contact pairs 31 and 32 in conjunction with the movement of the switch member 25. The controlling mechanism 70 is a mechanism configured to prevent the switch member 25 from moving from the breaking position to the connecting position before the mating of the power-supply-side connector 20 and the apparatus-side connector 10. The restricting mechanism 80 is a mechanism configured to prevent separation of the power-supply-side connector 20 and the apparatus-side connector 10 in response to a movement of the switch member 25 from the breaking position to the connecting position with the power-supply-side connector 20 and the apparatus-side connector 10 being mated. The remaining part of the restricting mechanism 80 is provided in the apparatus-side connector 10.

As illustrated in FIG. 5A through FIG. 7, the opening and closing mechanism 60 includes, for example, a movable member 61, an intermediate member 62, and a link member 63. The movable member 61 is an insulative member supported on the switch member 25 through the link member 63. The movable member 61 is configured, for example, to move parallel to the moving directions (the directions of arrows X1 and X2) of the switch member 25 with the movement of the switch member 25.

The intermediate member 62 is an insulative member interposed between the movable member 61 and the internal contact pairs 31 and 32. The intermediate member 62 is configured to, for example, turn (in the directions of arrows Z1 and Z2) perpendicular to the moving directions (the directions of arrows X1 and X2) of the switch member 25 with the movement of the switch member 25. For example, the intermediate member 62 includes a slope 621 capable of contacting the movable member 61, projecting parts 622 and 623 capable of contacting the internal contact pairs 622 and 623, respectively, and a rotating shaft 624, which are formed to be unitary.

As illustrated in FIG. 5A and FIG. 6, with the switch member 25 in the breaking position, the internal contact pairs 31 and 32 are open and establish no connections. Here, moving the switch member 25 in the direction of arrow X1 from the breaking position to the connecting position causes the link member 63 linked to the switch member 25 to push the movable member 61 in the direction of arrow X1, so that the movable member 61 moves in the direction of arrow X1. As a result, the movable member 61 pushes the slope 621 of the intermediate member 62 in the direction of arrow X1, so that the intermediate member 62 turns in the direction of arrow Z1 about the rotating shaft 624 against the restoring forces of the metal leaf springs 313 and 323. Consequently, as illustrated in FIG. 5B and FIG. 7, the projecting parts 622 and 623 of the intermediate member 62 cause the metal leaf springs 313 and 323, respectively, to elastically deform in the direction of arrow Z1, so that the internal contact pairs 31 and 32 are closed.

On the other hand, as illustrated in FIG. 5B and FIG. 7, with the switch member 25 in the connecting position, the internal contact pairs 31 and 32 are closed and establish connections. Here, moving the switch member 25 in the direction of arrow X2 from the connecting position to the breaking position causes the link member 63 linked to the switch member 25 to push the movable member 61 in the direction of arrow X2, so that the movable member 61 moves in the direction of arrow X2. As a result, the intermediate member 62 turns in the direction of arrow Z2 about the rotating shaft 624 with the restoring forces of the metal leaf springs 313 and 323. Consequently, as illustrated in FIG. 5A and FIG. 6, the metal leaf springs 313 and 323 are restored in the direction of arrow Z2, so that the internal contact pairs 31 and 32 are opened.

Thus, the opening and closing mechanism 60 opens or closes the internal contact pairs 31 and 32 in conjunction with the movement of the switch member 25.

The opening and closing mechanism 60 is not limited to a particular configuration, and may be designed suitably in accordance with the configuration and type of the switch member 25 and the configuration and type of the internal contact pairs 31 and 32.

As illustrated in FIGS. 5A and 5B, the power-supply-side connector 20 has a permanent magnet 26 provided near the terminals 321 and 322 of the internal contact pair 32. The permanent magnet 26 is for blowing off an arc generated momentarily when a flow of electric current is interrupted by the separation of the terminals 321 and 322. Likewise, the power-supply-side connector 20 has a permanent magnet (not graphically illustrated) provided near the terminals 311 and 312 of the internal contact pair 31 as well.

The controlling mechanism 70 is a mechanism configured to prevent movement of the switch member 25 from the breaking position to the connecting position and allow movement of the switch member 25 from the connecting position to the breaking position before the mating of the power-supply-side connector 20 and the apparatus-side connector 10. This controlling mechanism 70 allows the switch member 25 to move in either direction after the mating of the power-supply-side connector 20 and the apparatus-side connector 10.

Figure 8A:
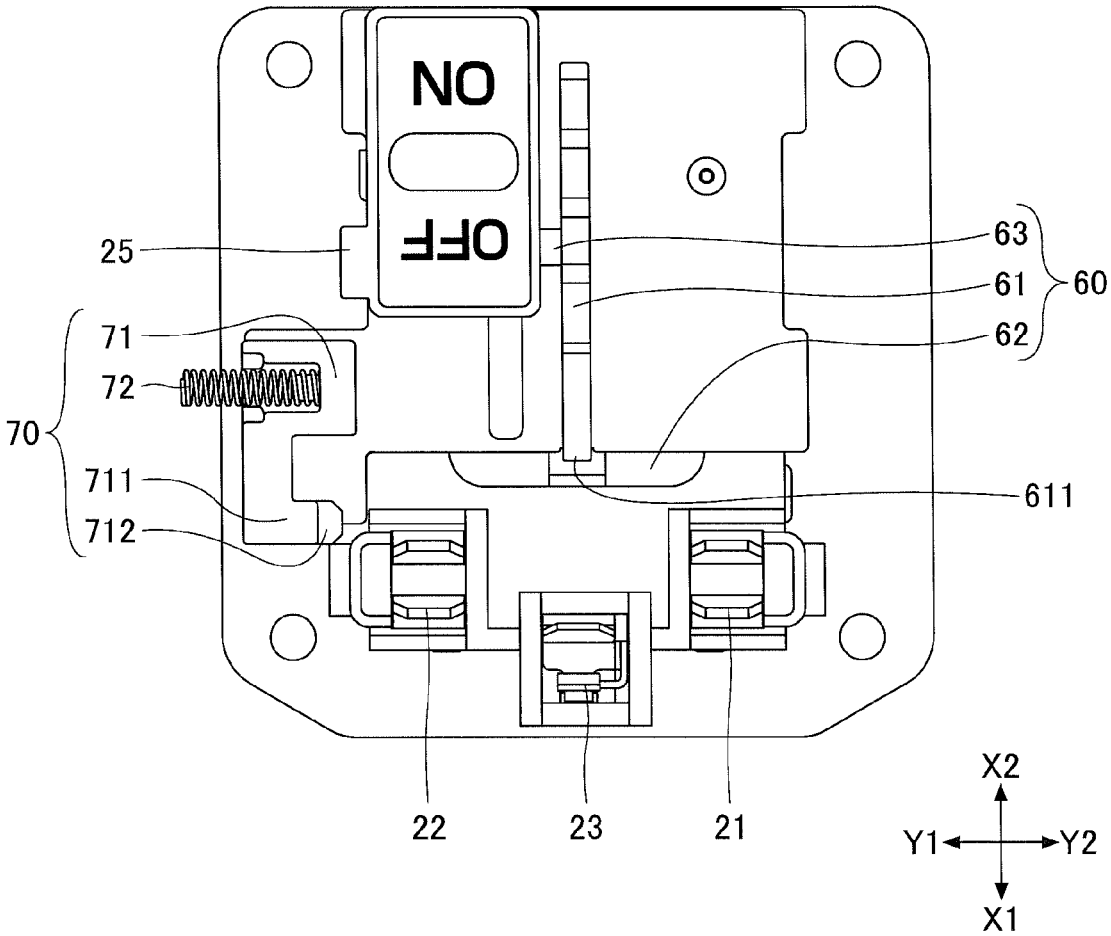
FIG. 8A is a transparent inside view of FIG. 4A according to the first embodiment.
Figure 8B:
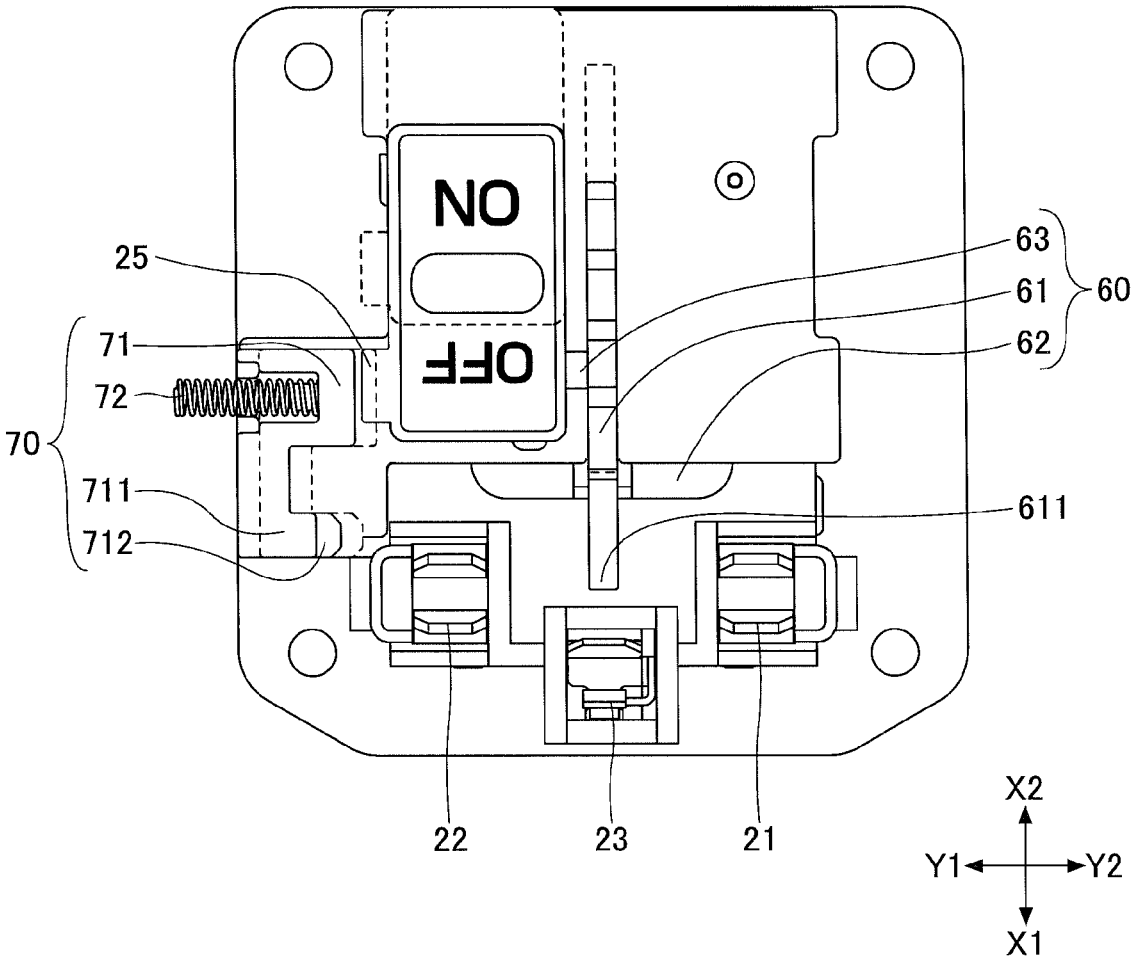
FIG. 8B is a transparent inside view of FIG. 4B according to the first embodiment.

A description is given, with reference to FIGS. 4A and 4B and FIGS. 8A and 8B, of a configuration of the controlling mechanism 70. FIGS. 8A and 8B are transparent inside views of FIGS. 4A and 4B, illustrating the state where the switch member 25 is in the breaking position before the mating of the power-supply-side connector 20 and the apparatus-side connector 10 and the state where the switch member 25 is in the connecting position after the mating of the power-supply-side connector 20 and the apparatus-side connector 10, respectively. The state indicated by broken lines in FIG. 8B is the state in FIG. 8A.

For example, as illustrated in FIGS. 8A and 8B, the controlling mechanism 70 is configured to be movable between an entering position at which to enter the path of movement of the switch member 25 and a retreat position outside the path of movement of the switch member 25. The controlling mechanism 70 includes an insulative movable member 71. The movable member 71 is urged to the entering position from the retreat position by an urging member 72. For example, as illustrated in FIGS. 8A and 8B, a coil spring may be used as the urging member 72. Alternatively, a helical torsion coil spring or a leaf spring may be used in place of the coil spring.

The movable member 71 is configured to be pressed by the apparatus-side connector 10 to move from the entering position to the retreat position at the time of mating the power-supply-side connector 20 and the apparatus-side connector 10. For example, as illustrated in FIG. 4A, the movable member 71 has a button part 711 projectable from the inner wall surface of the recess 24.

As illustrated in FIG. 8A, with the switch member 25 in the breaking position before the mating of the power-supply-side connector 20 and the apparatus-side connector 10, the movable member is in the entering position to prevent the movement of the switch member 25 from the breaking position to the connecting position (a movement in the direction of arrow X1).

Mating the power-supply-side connector 20 and the apparatus-side connector in this state causes the projecting part 14 (see, for example, FIG. 2A) of the apparatus-side connector 10 to fit into the recess 24 in the direction of arrow Z1. At this point, the projecting part 14 pushes a slope 712 (see also FIG. 6 and FIG. 7) of the button part 711 in the direction of arrow Z1, so that the button part 711 moves in a retraction direction (the direction of arrow Y1). As a result, the movable member 71 moves in the direction of arrow Y1. Consequently, as illustrated in FIG. 8B, the movable member 71 moves to the retreat position to allow the movement of the switch member 25 from the breaking position to the connecting position (a movement in the direction of arrow X1).

On the other hand, as illustrated in FIG. 8B, with the switch member 25 in the connecting position after the mating of the power-supply-side connector 20 and the apparatus-side connector 10, the movable member 71 is in the retreat position to allow the movement of the switch member 25 from the connecting position to the breaking position (a movement in the direction of arrow X2).

Moving the switch member 25 from the connecting position to the breaking position and then separating the power-supply-side connector 20 and the apparatus-side connector 10 in this state causes the projecting part 14 to no longer push the button part 711. Therefore, the movable member 71 is caused to move in the direction of arrow Y2 by the urging force of the urging member 72. As a result, as illustrated in FIG. 8A, the movable member 71 moves to the entering position to prevent the movement of the switch member 25 from the breaking position to the connecting position.

Thus, according to this embodiment, before the mating of the power-supply-side connector 20 and the apparatus-side connector 10, the switch member 25 is prevented from moving from the breaking position to the connecting position so that it is possible to prevent the power supply 50 and the power feeding terminals 21 and 22 from being electrically connected. Therefore, it is possible to prevent a conductor such as a screwdriver from being fed with electric power when the conductor comes into contact with the power feeding terminal 21 or 22.

Further, according to this embodiment, the controlling mechanism 70 is formed only of mechanical components such as the movable member 71. Accordingly, compared with the case where the controlling mechanism 70 is formed of electronic components such as a position sensor and an actuator, it is possible to reduce power consumption.

Furthermore, according to this embodiment, as illustrated in FIG. 4A, the button part 711 of the movable member 71 is provided in the recess 24. This makes it possible to prevent the button part 711 from being wrongly operated. In order to prevent the button part 711 from being wrongly operated manually, the opening width W of the recess (see FIG. 4A) is desirably less than or equal to 10 mm, more desirably less than or equal to 5 mm, and still more desirably less than or equal to 3 mm.

According to this embodiment, the switch member 25 is moved from the connecting position to the breaking position before separating the power-supply-side connector 20 and the apparatus-side connector 10. Embodiments of the present invention, however, are not limited to this configuration. For example, in the absence of the below-described restricting mechanism 80, the power-supply-side connector 20 and the apparatus-side connector 10 may be separated before moving the switch member 25 from the connecting position to the breaking position.

According to this embodiment, the movable member 71 is configured to enter or retreat from the path of movement of the switch member 25. Embodiments of the present invention, however, are not limited to this configuration. For example, the movable member 71 may be configured to enter or retreat from the path of movement of a member interposed between the switch member 25 and the internal contact pairs 31 and 32 (such as the movable member 61 or the intermediate member 62).

The restricting mechanism 80 is a mechanism configured to prevent separation of the power-supply-side connector 20 and the apparatus-side connector 10 in response to a movement of the switch member 25 from the breaking position to the connecting position with the power-supply-side connector 20 and the apparatus-side connector 10 being mated. This restricting mechanism 80 allows separation of the power-supply-side connector 20 and the apparatus-side connector 10 in response to a movement of the switch member 25 from the connecting position to the breaking position with the power-supply-side connector 20 and the apparatus-side connector 10 being mated.

A description is given, with reference to FIG. 2A through FIG. 4B and FIGS. 9A and 9B, of a configuration of the restricting mechanism 80. FIGS. 9A and 9B are diagrams illustrating the restricting mechanism 80. FIG. 9A is a cross-sectional view of the connector unit, illustrating a state where the switch member 25 is in the breaking position before the mating of the power-supply-side connector 20 and the apparatus-side connector 10. FIG. 9B is a cross-sectional view of the connector unit, illustrating a state where the switch member 25 is in the connecting position after the mating of the power-supply-side connector 20 and the apparatus-side connector 10.

For example, as illustrated in FIG. 2A through FIG. 4B and FIGS. 9A and 9B, the restricting mechanism 80 includes an engaging hole 81 provided in the housing 10*a* of the apparatus-side connector 10 to be perpendicular to the mating direction and the movable member 61 linked to the switch member 25 via the link member 63. As illustrated in FIG. 2A, FIG. 3B, and FIGS. 9A and 9B, the engaging hole 81 is provided in the projecting part 14 of the apparatus-side connector 10.

The movable member 61 is configured to have an end part 611 of the movable member 61 inserted into the engaging hole 81 in response to a movement of the switch member 25 from the breaking position to the connecting position with the power-supply-side connector 20 and the apparatus-side connector 10 being mated. As illustrated in FIG. 4B, the movable member 61 is configured to have the end part 611 project from the inner wall surface of the recess 24 of the power-supply-side connector 20 in conjunction with the movement of the switch member 25.

As illustrated in FIG. 9A, with the switch member 25 in the breaking position before the mating of the power-supply-side connector 20 and the apparatus-side connector 10, the end part 611 of the movable member 61 does not project from the inner wall surface of the recess 24 to allow the fitting of the recess 24 and the projecting part 14.

Mating the power-supply-side connector 20 and the apparatus-side connector 10 in this state causes the recess 24 and the projecting part 14 to be fit together. A subsequent movement of the switch member 25 in the direction of arrow X1 from the breaking position to the connecting position causes the link member 63 linked to the switch member 25 to push the movable member 61 in the direction of arrow X1, so that the movable member 61 moves in the direction of arrow X1. As a result, as illustrated in FIG. 9B, the end part 611 of the movable member 61 projects in the direction of arrow X1 from the inner wall surface of the recess 24 to be inserted into an engaging hole 82 of the power-supply-side connector 20 through the engaging hole 81 of the apparatus-side connector 10.

On the other hand, as illustrated in FIG. 9B, with the switch member 25 in the connecting position after the mating of the power-supply-side connector 20 and the apparatus-side connector 10, the movable member 61 has its end part 611 inserted in the engaging holes 81 and 82 in the direction of arrow X1 so as to prevent the power-supply-side connector 20 and the apparatus-side connector 10 from being separated in the directions of arrows Z1 and Z2.

Moving the switch member 25 in the direction of X2 from the connecting position to the breaking position in this state causes the link member 63 linked to the switch member 25 to push the movable member 61 in the direction of arrow X2, so that the movable member 61 moves in the direction of arrow X2. As a result, the end part 611 of the movable member 61 comes out of the engaging holes 81 and 82 to go inside the inner wall surface of the recess 24. Consequently, the recess 24 and the projecting part 14 are allowed to be separated, so that the power-supply-side connector 20 and the apparatus-side connector 10 are allowed to be separated.

Thus, according to this embodiment, the switch member 25 moves from the breaking position to the connecting position to prevent the separation of the power-supply-side connector 20 and the apparatus-side connector 10. Accordingly, it is possible to prevent a conductor such as a screwdriver from coming into contact with the power feeding terminal 21 or 22 with the power supply 50 and the power feeding terminals 21 and 22 being electrically connected.

Further, according to this embodiment, the restricting mechanism 80 is formed only of mechanical components such as the movable member 61. Accordingly, compared with the case where the restricting mechanism 80 is formed of electronic components such as a position sensor and an actuator, it is possible to reduce power consumption.

Further, according to this embodiment, the apparatus-side connector 10 is provided with the engaging hole 81 and the power-supply-side connector 20 is provided with the movable member 61 insertable into the engaging hole 81. Accordingly, it is possible to prevent an improper electrical apparatus and the power supply 50 from being electrically connected. That is, in the case of mistakenly mating a similar apparatus-side connector without the engaging hole 81 with the power-supply-side connector 20, the apparatus-side connector prevents the movement of the movable member 61. Accordingly, it is possible to prevent the switch member 25 linked to the movable member 61 from moving to the connecting position.

Figure 10:
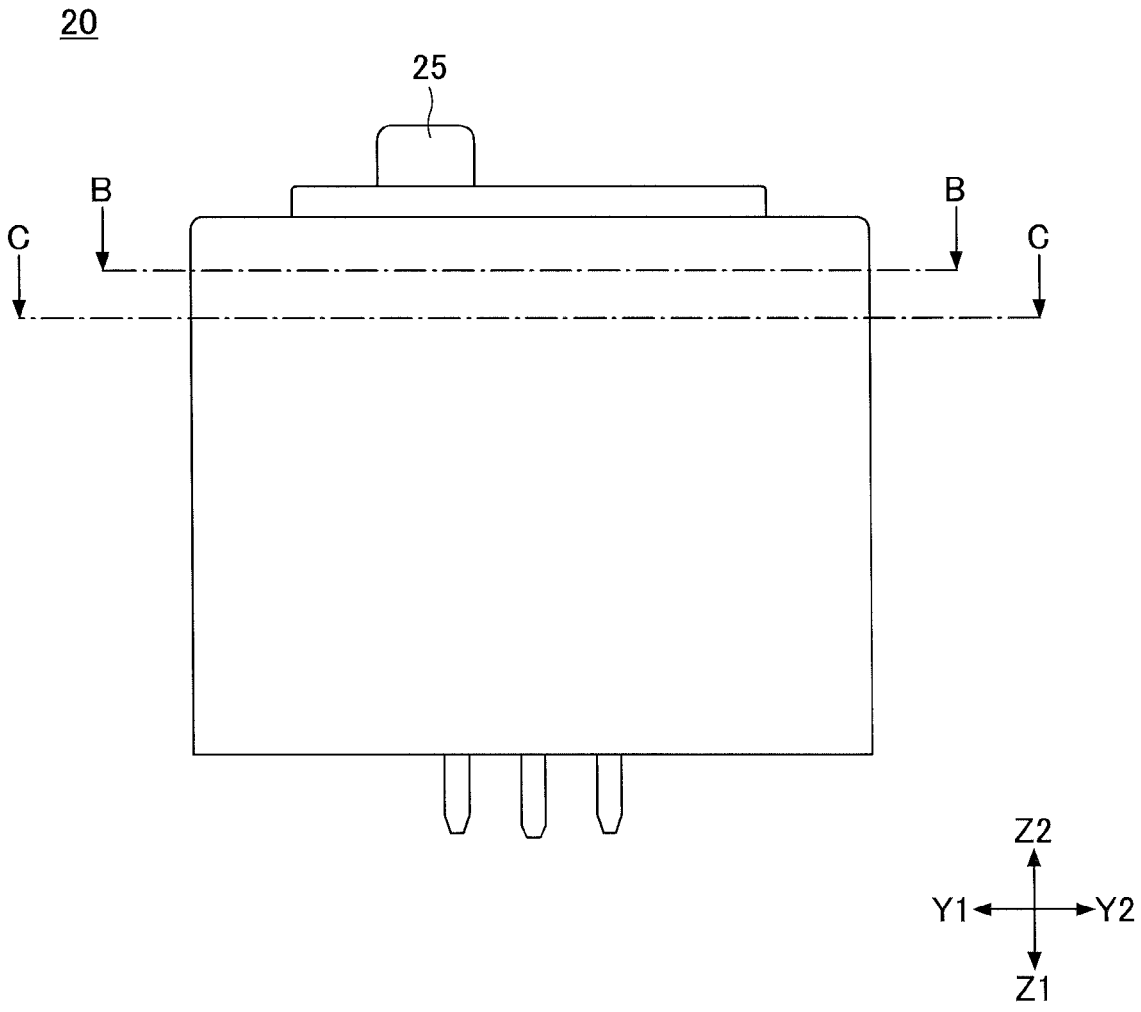
FIG. 10 is a front view of the power-supply-side connector according to the first embodiment.
Figure 11A:
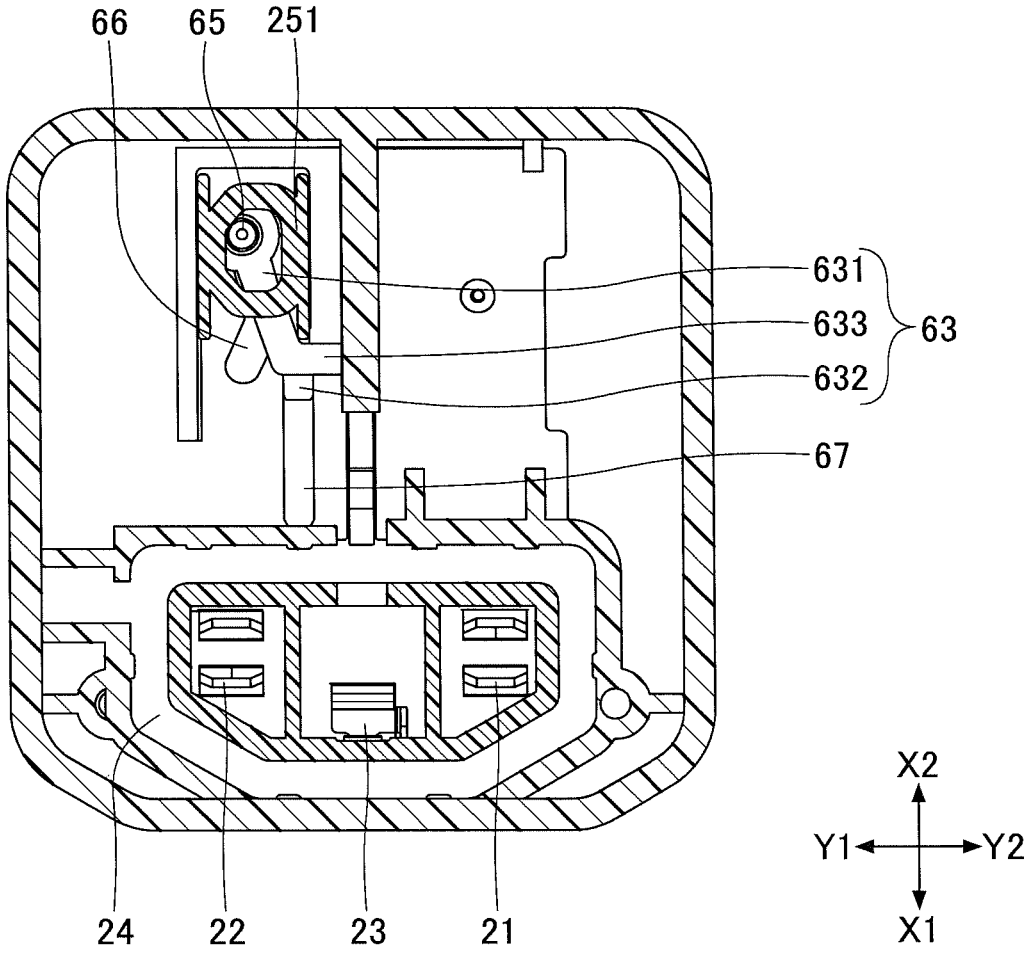
FIG. 11A is a cross-sectional view of the power-supply-side connector according to the first embodiment, taken along line B-B of FIG. 10.
Figure 11B:
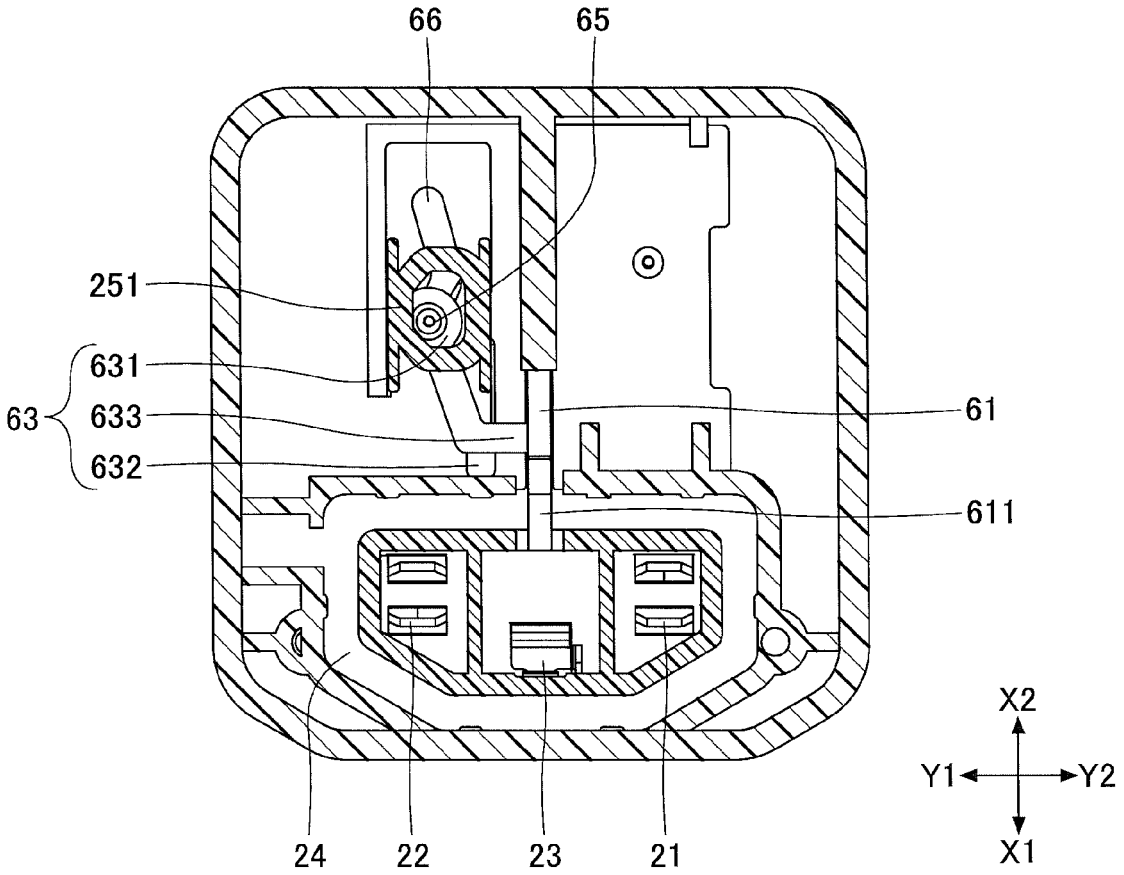
FIG. 11B is another cross-sectional view of the power-supply-side connector according to the first embodiment, taken along line B-B of FIG. 10.
Figure 12A:
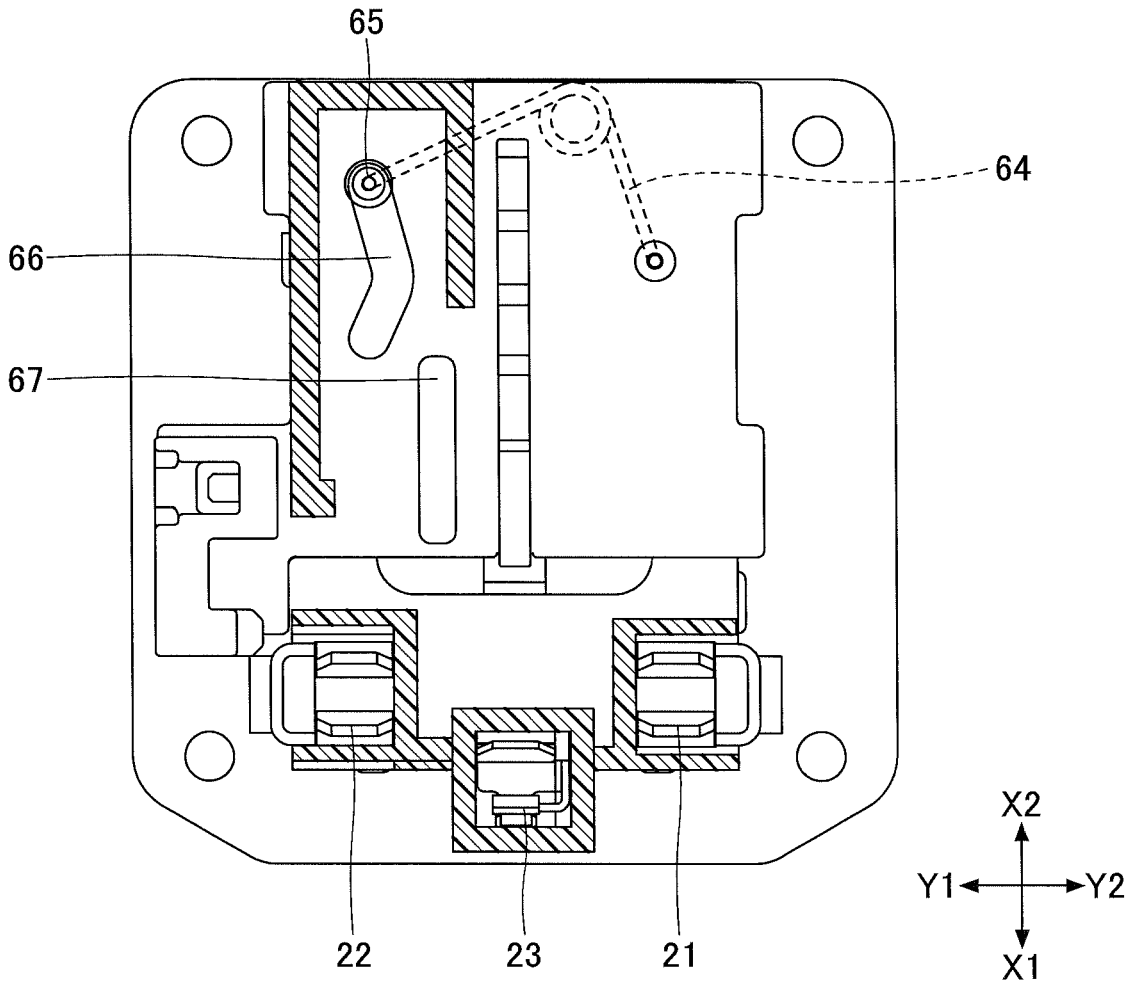
FIG. 12A is a cross-sectional view of the power-supply-side connector according to the first embodiment, taken along line C-C of FIG. 10.
Figure 12B:
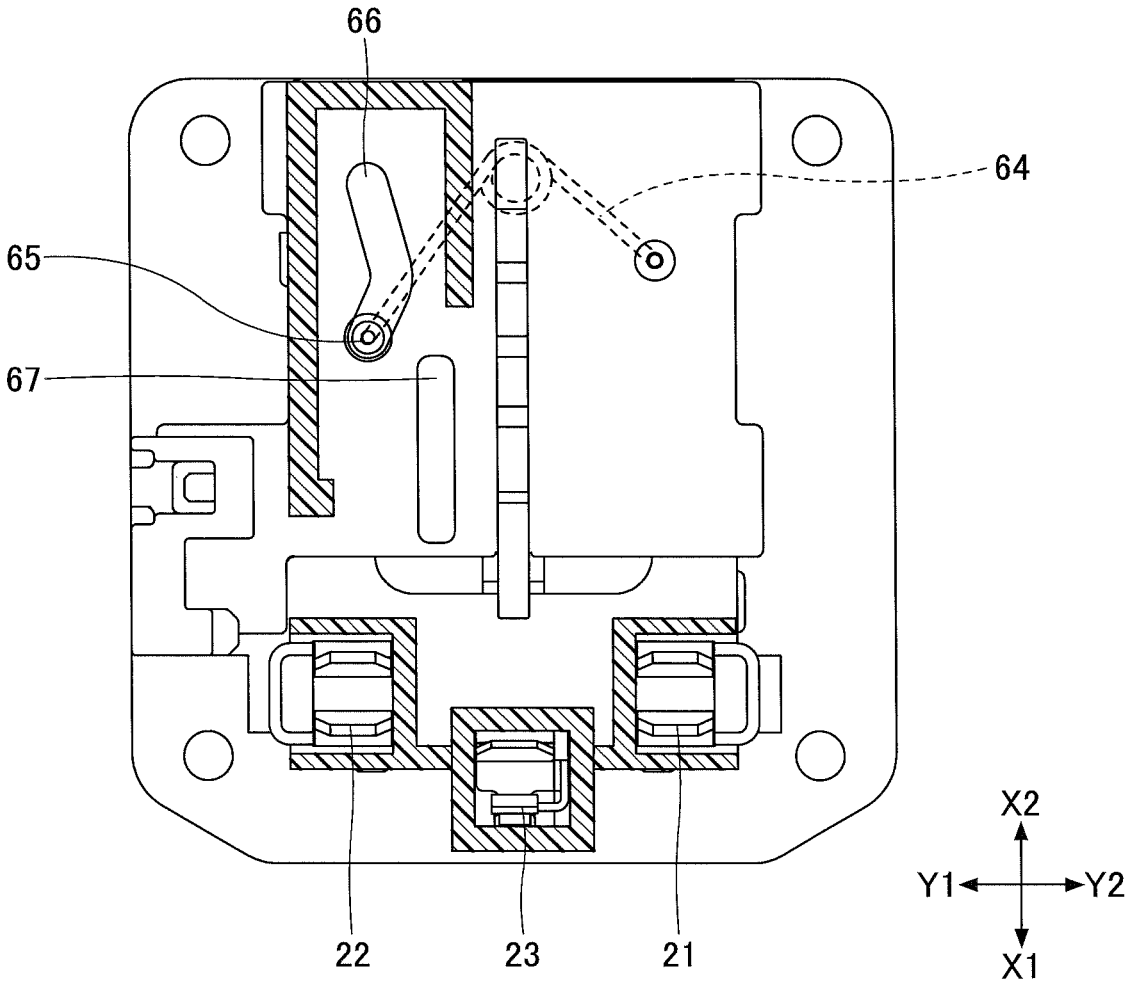
FIG. 12B is another cross-sectional view of the power-supply-side connector according to the first embodiment, taken along line C-C of FIG. 10.
Figure 13:
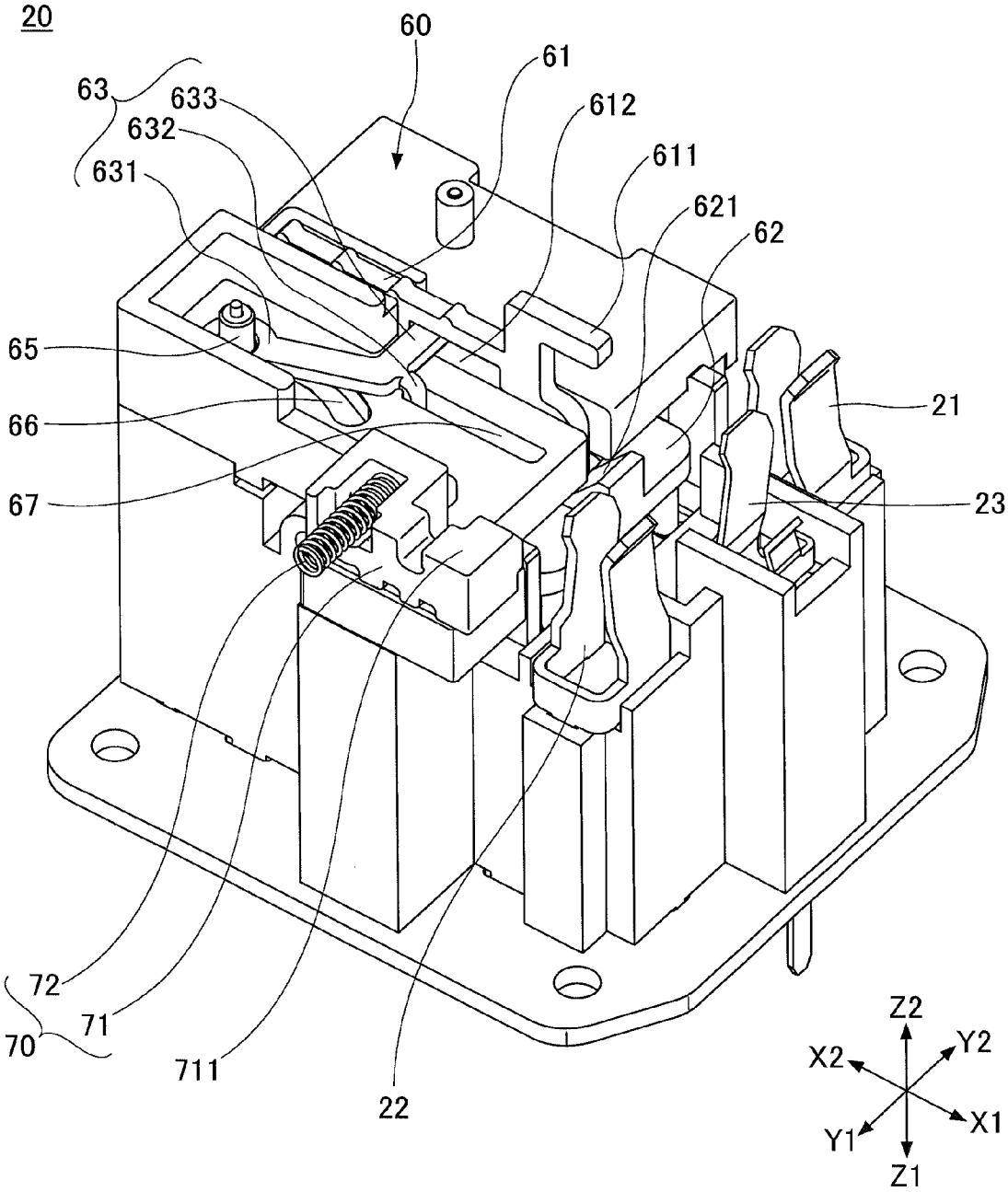
FIG. 13 is yet another perspective view of the internal structure of the power-supply-side connector according to the first embodiment.
Figure 14:
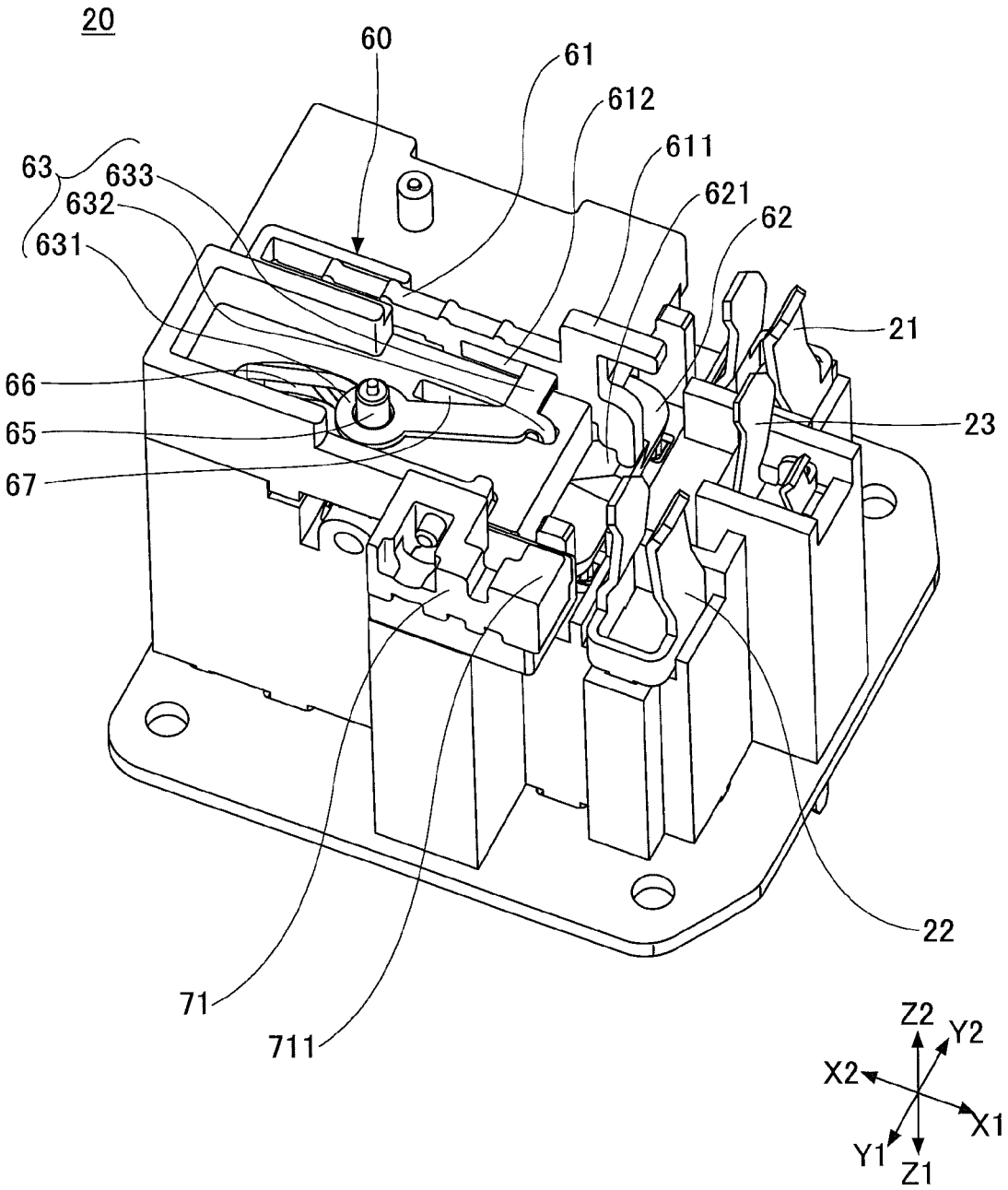
FIG. 14 is yet another perspective view of the internal structure of the power-supply-side connector according to the first embodiment.

Next, a description is given in more detail, with reference to FIG. 10 through FIG. 14, of the opening and closing mechanism 60. FIG. 10 is a front view of the power-supply-side connector 20. FIGS. 11A and 11B are cross-sectional views of the power-supply-side connector 20 taken along line B-B of FIG. 10, illustrating a state where the switch member 25 is in the breaking position and a state where the switch member 25 is in the connecting position, respectively. FIGS. 12A and 12B are cross-sectional views of the power-supply-side connector 20 taken along line C-C of FIG. 10, illustrating the state where the switch member 25 is in the breaking position and the state where the switch member 25 is in the connecting position, respectively. FIG. 13 is a perspective view of an internal structure of the power-supply-side connector 20, illustrating the state where the switch member 25 is in the breaking position. FIG. 14 is a perspective view of the internal structure of the power-supply-side connector 20, illustrating the state where the switch member 25 is in the connecting position.

As illustrated in FIGS. 11A and 11B, the switch member 25 includes an annular part 251 provided inside the power-supply-side connector 20, and is linked to the movable member 61 via the link member 63. Further, as illustrated in FIGS. 12A and 12B, the power-supply-side connector 20 has a helical torsion coil spring 64 provided inside. This helical torsion coil spring 64 has one end fixed to the housing 20*a* of the power-supply-side connector 20 in a turnable manner, and has the other end connected to a cam shaft 65 in a turnable manner. This cam shaft 65 is configured to be movable inside a V-shaped cam groove 66. As illustrated in FIGS. 11A and 11B, the cam shaft 65 is inserted in a first end part 631 of the link member 63 in a turnable manner.

As illustrated in FIGS. 11A and 11B and FIG. 13, the link member 63 includes a sliding shaft 632 provided in its center part so as to be slidable in a sliding groove 67. Further, the link member 63 has a second end part 633 inserted in a slidable manner in a buffer groove 612 provided in the movable member 61.

With the switch member 25 in the breaking position, the cam shaft 65 inserted in the first end part 631 of the link member 63 is positioned farthest on the X2 side in the cam groove 66 as illustrated in FIG. 12A, and is in contact with the inner wall surface of the annular part 251 on the X2 side as illustrated in FIG. 11A. Further, the sliding shaft 632 provided in the center part of the link member 63 is positioned on the X2 side in the sliding groove 67. Further, the second end part 633 of the link member 63 is in contact with the inner wall surface of the buffer groove 612 on the X2 side. At this point, the helical torsion coil spring 64 is slightly closed (bent) compared with its natural state.

Then, moving the switch member 25 in the direction of arrow X1 from the breaking position to the connecting position causes the X2-side inner wall surface of the annular part 251 to push the cam shaft 65 in the direction of arrow X1, so that the cam shaft 65 moves in the direction of arrow X1 in the cam groove 66. At this point, the link member 63 in which the cam shaft 65 is inserted also moves in the direction of arrow X1. However, since the second end part 633 of the link member 63 moves inside the buffer groove 612, the movable member 61 does not move. In this process, the helical torsion coil spring 64 is further closed (bent) compared with the state illustrated in FIG. 12A. Therefore, the restoring force of the helical torsion coil spring 64 has become greater.

Thereafter, when the switch member 25 reaches a position substantially halfway between the breaking position and the connecting position, the cam shaft 65 reaches a bent part of the V-shaped cam groove 66, so that the helical torsion coil spring 64 is bent most. In this state, the moving direction of the switch member 25 and a direction connecting both ends of the helical torsion coil spring 64 are perpendicular to each other.

Moving the switch member 25 further in the direction of arrow X1 from the halfway position to the connecting position results in the state illustrated in FIG. 11B, FIG. 12B, and FIG. 14 because of the restoring force of the helical torsion coil spring 64. That is, the restoring force of the helical torsion coil spring 64 to open its legs causes the cam shaft 65 to move in the direction of arrow X1 in the cam groove 66, so that the second end part 633 of the link member 63 moves in the direction of arrow X1 to push the X1-side inner wall surface of the buffer groove 612 of the movable member 61. As a result, as illustrated in FIG. 5B, the end part 611 of the movable member 61 projects in the direction of arrow X1 from the inner wall surface of the recess 24, and the movable member 61 pushes the intermediate member 62 to close the internal contact pairs 31 and 32.

The internal contact pairs 31 and 32 may be closed in this manner. This is performed with the restoring force of the helical torsion coil spring 64, that is, the force of the helical torsion coil spring 64 to open its legs. Therefore, this is performed in a short period of time.

On the other hand, with the switch member 25 in the connecting position, the cam shaft 65 inserted in the first end part 631 of the link member 63 is positioned farthest on the X1 side in the cam groove 66 as illustrated in FIG. 12B, and is in contact with the inner wall surface of the annular part 251 on the X1 side as illustrated in FIG. 11B. Further, the sliding shaft 632 provided in the center part of the link member 63 is positioned on the X1 side in the sliding groove 67. Further, the second end part 633 of the link member 63 is in contact with the inner wall surface of the buffer groove 612 on the X1 side. At this point, the helical torsion coil spring 64 is slightly closed (bent) compared with its natural state.

Then, moving the switch member 25 in the direction of arrow X2 from the connecting position to the breaking position causes the X1-side inner wall surface of the annular part 251 to push the cam shaft 65 in the direction of arrow X2, so that the cam shaft 65 moves in the direction of arrow X2 in the cam groove 66. At this point, the link member 63 in which the cam shaft 65 is inserted also moves in the direction of arrow X2. However, since the second end part 633 of the link member 63 moves inside the buffer groove 612, the movable member 61 does not move. In this process, the helical torsion coil spring 64 is further closed (bent) compared with the state illustrated in FIG. 12B. Therefore, the restoring force of the helical torsion coil spring 64 has become greater.

Thereafter, when the switch member 25 reaches the position substantially halfway between the breaking position and the connecting position, the cam shaft 65 reaches the bent part of the V-shaped cam groove 66, so that the helical torsion coil spring 64 is bent most. In this state, the moving direction of the switch member 25 and a direction connecting both ends of the helical torsion coil spring 64 are perpendicular to each other.

Moving the switch member 25 further in the direction of arrow X2 from the halfway position to the connecting position results in the state illustrated in FIG. 11A, FIG. 12A, and FIG. 13 because of the restoring force of the helical torsion coil spring 64. That is, the restoring force of the helical torsion coil spring 64 to open its legs causes the cam shaft 65 to move in the direction of arrow X2 in the cam groove 66, so that the second end part 633 of the link member 63 moves in the direction of arrow X2 to push the X2-side inner wall surface of the buffer groove 612 of the movable member 61. As a result, as illustrated in FIG. 5A, the end part 611 of the movable member 61 retracts in the direction of arrow X2 from the inner wall surface of the recess 24, and the movable member 61 moves in the direction of arrow X2 to open the internal contact pairs 31 and 32.

The internal contact pairs 31 and 32 may be opened in this manner. This is performed with the restoring force of the helical torsion coil spring 64, that is, the force of the helical torsion coil spring 64 to open its legs. Therefore, this is performed in a short period of time.

According to this embodiment, the internal contact pairs 31 and 32 are opened and closed with the restoring force of the helical torsion coil spring 64. Therefore, it is possible to cause the speed of opening and closing to be constant. Accordingly, it is possible to prevent the occurrence of an arc or chattering due to a slow opening or closing speed. The occurrence of an arc or chattering may damage contacts of the power-supply-side connector 20 or an apparatus connected to the power-supply-side connector 20.

According to this embodiment, the helical torsion coil spring 64 is used as an elastic member deformed or restored by the movement of the switch member 25. However, embodiments of the present invention are not limited to this, and, for example, a coil spring or a leaf spring may also be used as the elastic member.

Figure 15:
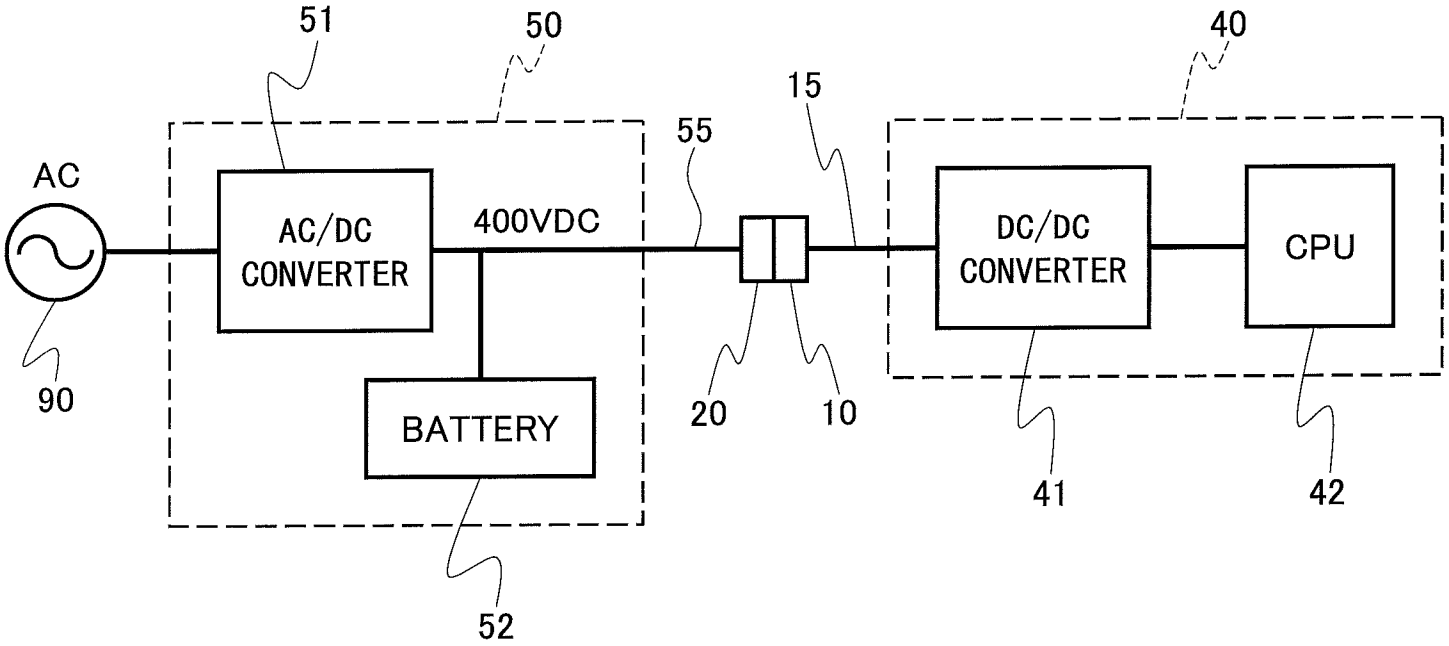
FIG. 15 is a diagram illustrating a configuration of an electric power supply system using the connector unit according to the first embodiment.

Next, a description is given, with reference to FIG. 15, of a configuration of an electric power supply system using the above-described connector unit. FIG. 15 is a diagram illustrating a configuration of an electric power supply system using the connector unit according to the first embodiment.

According to this electric power supply system, electric power of 100 VAC or 200 VAC supplied from a commercial power supply 90 is input to the power supply 50, where 100 VAC or 200 VAC is converted into 400 VDC with an AC/DC converter 51 in the power supply 50. It is possible to store direct-current electric power as energy using a battery or the like. Accordingly, by providing a backup battery 52 in the power supply 50, it is possible to readily respond to situations such as a power failure. The power-supply-side connector 20 is connected to the power supply 50 via a power supply cable 55, so that the electric power of 400 VDC from the power supply 50 is supplied through the power-supply-side connector 20.

On the other hand, the apparatus-side connector 10 is connected to the electrical apparatus 40 such as a server via the power supply cable 15. The power-supply-side connector 20 and the apparatus-side connector 10 are electrically connected so that the electric power from the power supply 50 is supplied to the electrical apparatus 40.

Further, the electrical apparatus 40 includes a DC/DC converter 41 that converts 400 VDC into low-voltage DC output with which electronic components of the electrical apparatus 40, such as a CPU 42, can operate.

This electric power supply system is advantageous in, for example, that power loss is small because there is only one DC conversion of the AC power from the commercial power supply 90; it is not necessary to pay much attention to the thickness of a lead wire or the like in the case of the high-voltage direct current of 400 VDC; and it is easy to respond to the suspension of the power supply of the commercial power supply 90 due to a power failure or the like because the supplied power is direct current and storable as energy in the battery 52.

Figure 16:
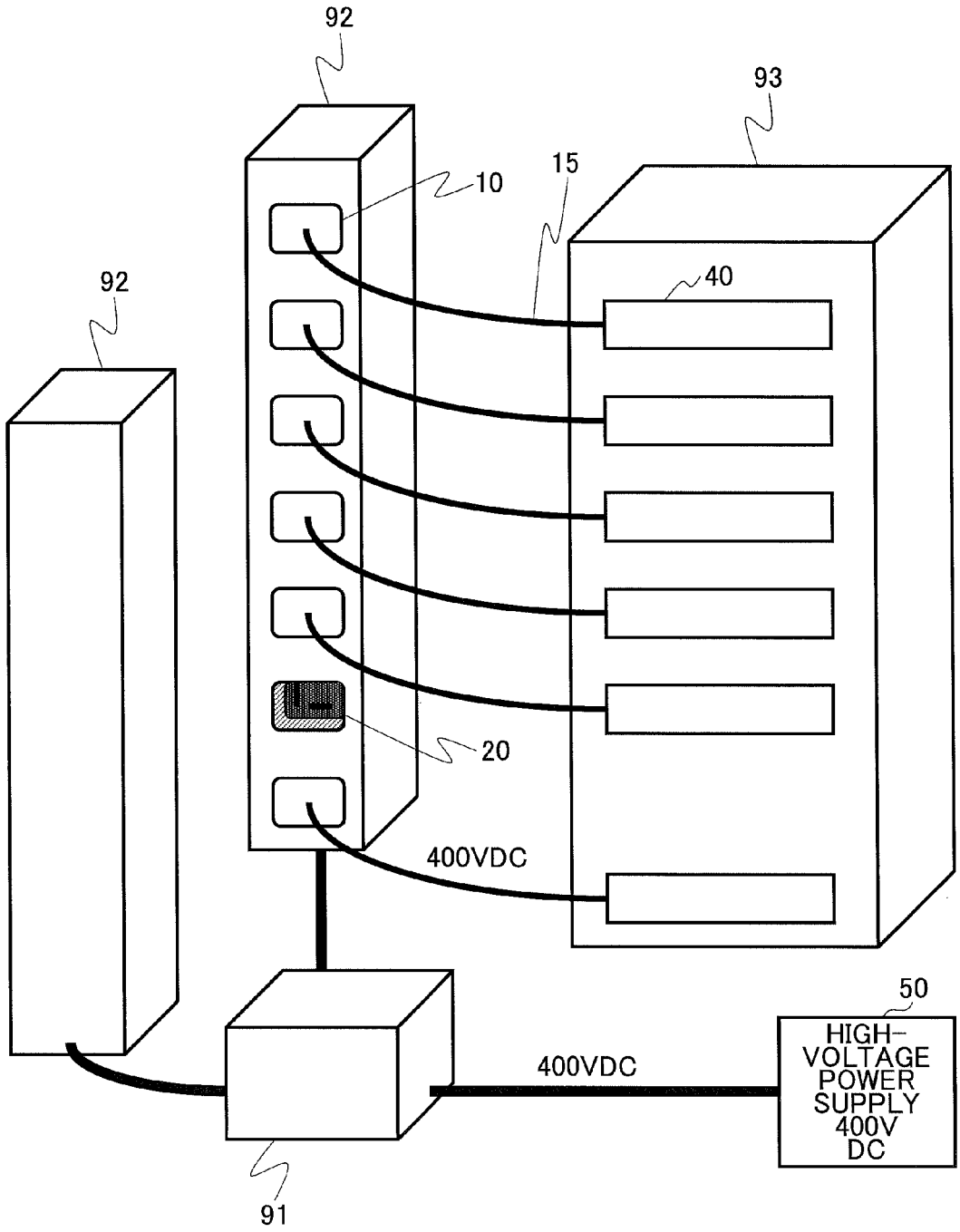
FIG. 16 is a perspective view of a system including a power distribution unit using the connector unit according to the first embodiment.

Next, a description is given, with reference to FIG. 16, of a power distribution unit (PDU) using the connector unit according to this embodiment.

Referring to FIG. 16, the electric power of 400 VDC supplied from the power supply 50 is first input to a distribution board 91, which distributes the input electric power to multiple PDUs 92. Each PDU 92 includes multiple power-supply-side connectors 20 according to this embodiment, and is capable of supplying the 400 VDC electric power through each of the power-supply-side connectors 20. On the other hand, a server rack 93 houses multiple electrical apparatuses 40 such as servers, which are connected to respective apparatus-side connectors 10 for receiving a supply of electric power via power supply cables 15. The apparatus-side connectors 10 are electrically connected to the corresponding power-supply-side connectors 20 provided in the PDUs 92 so that the electrical apparatuses 40 are supplied with the 400 VDC electric power.

The connector unit, the apparatus-side connector 10, and the power-supply-side connector 20 according to this embodiment, which are applicable to each of direct current (DC) and alternating current (AC), are particularly suitable in the case of a direct current whose voltage is higher than or equal to 48 V.

Second Embodiment

Figure 17:
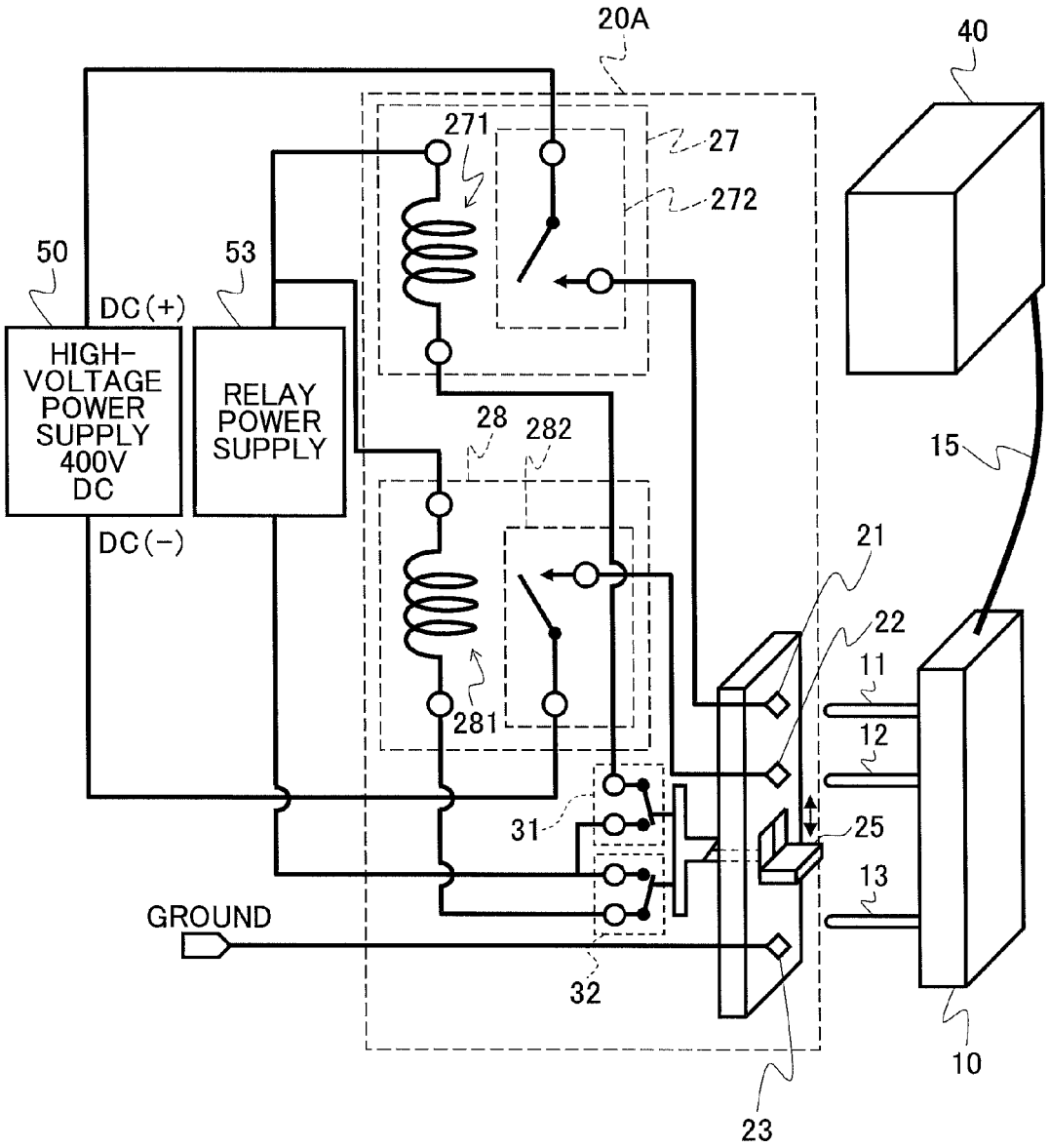
FIG. 17 is a diagram illustrating a configuration of a connector unit according to a second embodiment.

FIG. 17 illustrates an overview of a connector unit, an apparatus-side connector, and a power-supply-side connector according to a second embodiment. In FIG. 17, the same elements as those of FIG. 1 through FIG. 16 are referred to by the same characters, and a description thereof is omitted.

According to the second embodiment, a power-supply-side connector 20A includes two relays 27 and 28. A relay power supply 53 for driving the relays 27 and 28 is connected to the power-supply-side connector 20A.

The relay 27 includes a coil 271 and a relay contact pair 272 configured to be closed and establish a connection in response to causing electric current to flow through the coil 271. With no electric current flowing through the coil 271, the relay contact pair 272 is open and establishes no connection. Likewise, the relay 28 includes a coil 281 and a relay contact pair 282 configured to be closed and establish a connection in response to causing electric current to flow through the coil 281. With no electric current flowing through the coil 281, the relay contact pair 282 is open and establishes no connection.

As illustrated in FIG. 17, the coil 271 has one of its terminals connected to the positive output of the relay power supply 53 and has the other one of its terminals connected to the negative output of the relay power supply 53 through the internal contact pair 31. Likewise, the coil 281 has one of its terminals connected to the positive output of the relay power supply 53 and has the other one of its terminals connected to the negative output of the relay power supply 53 through the internal contact pair 32.

The relay contact pair 272 includes two terminals (contacts) capable of coming into contact with and separable from each other. As illustrated in FIG. 17, the relay contact pair 272 has one of the terminals connected to the positive output of the power supply 50 and has the other one of the terminals connected to the power feeding terminal 21. Likewise, the relay contact pair 282 includes two terminals (contacts) capable of coming into contact with and separable from each other. The relay contact pair 282 has one of the terminals connected to the negative output of the power supply 50 and has the other one of the terminals connected to the power feeding terminal 22.

According to this embodiment, in response to a movement of the switch member 25 from the breaking position to the connecting position, the internal contact pair 31 is closed to cause electric current to flow through the coil 271. As a result, the relay contact pair 272 is (has its terminals) closed so that the positive output of the power supply 50 and the power feeding terminal 21 are electrically connected. Likewise, in response to the movement of the switch member 25 from the breaking position to the connecting position, the internal contact pair 32 is (has its terminals) closed to cause electric current to flow through the coil 281. As a result, the relay contact pair 282 is closed so that the negative output of the power supply 50 and the power feeding terminal 22 are electrically connected.

Further, according to this embodiment, in response to a movement of the switch member 25 from the connecting position to the breaking position, the internal contact pair 31 is opened to prevent electric current from flowing through the coil 271. As a result, the relay contact pair 272 is (has its terminals) opened to electrically disconnect the positive output of the power supply 50 and the power feeding terminal 21. Likewise, in response to the movement of the switch member 25 from the connecting position to the breaking position, the internal contact pair 32 is (has its terminals) opened to prevent electric current from flowing through the coil 281. As a result, the relay contact pair 282 is opened to electrically disconnect the negative output of the power supply 50 and the power feeding terminal 22.

Thus, the power supply 50 and the power feeding terminals 21 and 22 are electrically connected or disconnected in conjunction with the movement of the switch member 25.

According to this embodiment, the power supply 50 and the power feeding terminals 21 and 22 are electrically connected or disconnected using the relays 27 and 28. Accordingly, it is possible to further increase safety.

According to this embodiment, the relays 27 and 28 are provided inside the body of the power-supply-side connector 20A. Alternatively, the relays 27 and 28 may be provided outside the body of the power-supply-side connector 20A.

The connector unit according to this embodiment may be used in the electric power supply system described in the first embodiment.

Third Embodiment

Figure 18:
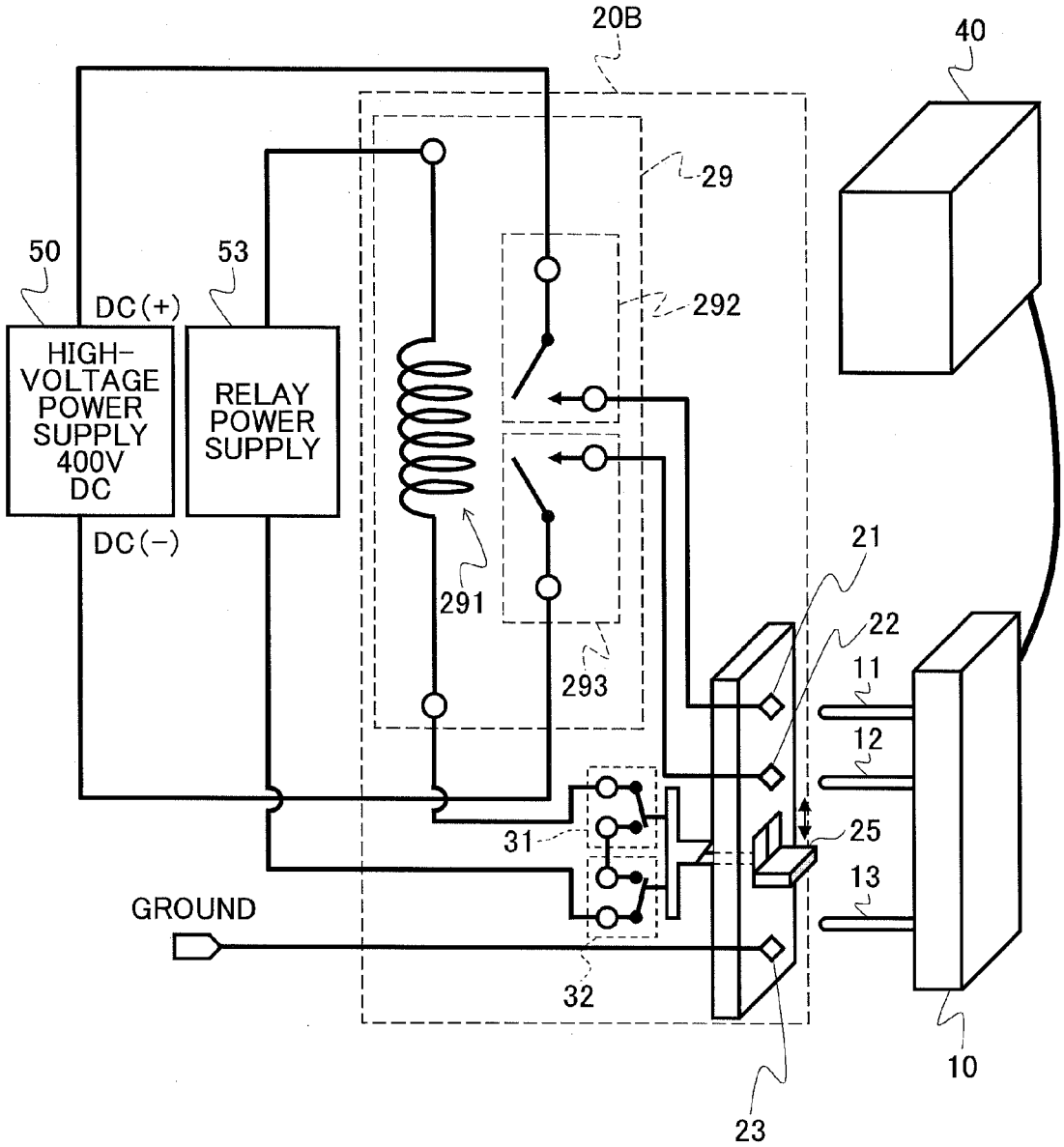
FIG. 18 is a diagram illustrating a configuration of a connector unit according to a third embodiment.

FIG. 18 illustrates an overview of a connector unit, an apparatus-side connector, and a power-supply-side connector according to a third embodiment. In FIG. 18, the same elements as those of FIG. 1 through FIG. 17 are referred to by the same characters, and a description thereof is omitted.

According to the third embodiment, the power-supply-side connector 20B includes a single relay 29. The relay power supply 53 for driving the relay 29 is connected to the power-supply-side connector 20B.

The relay 29 includes a coil 291 and two relay contact pairs 292 and 293 configured to be closed and establish connections in response to causing electric current to flow through the coil 291. With no electric current flowing through the coil 291, the relay contact pairs 292 and 293 are open and establish no connections.

As illustrated in FIG. 18, the coil 291 has one of its terminals connected to the positive output of the relay power supply 53 and has the other one of its terminals connected to the negative output of the relay power supply 53 through the internal contact pairs 31 and 32. According to this embodiment, the two internal contact pairs 31 and 32 are connected in series. Alternatively, however, the internal contact pairs 31 and 32 may be connected in parallel or one of the internal contact pairs 31 and 32 may not be provided.

As illustrated in FIG. 18, the relay contact pair 292 includes two terminals (contacts) capable of coming into contact with and separable from each other. The relay contact pair 292 has one of the terminals connected to the positive output of the power supply 50 and has the other one of the terminals connected to the power feeding terminal 21. Likewise, the relay contact pair 293 includes two terminals (contacts) capable of coming into contact with and separable from each other. The relay contact pair 293 has one of the terminals connected to the negative output of the power supply 50 and has the other one of the terminals connected to the power feeding terminal 22.

According to this embodiment, in response to a movement of the switch member 25 from the breaking position to the connecting position, the internal contact pairs 31 and 32 are closed to cause electric current to flow through the coil 291. As a result, the relay contact pair 292 is (has its terminals) closed to electrically connect the positive output of the power supply 50 and the power feeding terminal 21. Simultaneously, the relay contact pair 293 is (has its terminals) closed to electrically connect the negative output of the power supply 50 and the power feeding terminal 22.

Further, according to this embodiment, in response to a movement of the switch member 25 from the connecting position to the breaking position, the internal contact pairs 31 and 32 are opened to prevent electric current from flowing through the coil 291. As a result, the relay contact pair 292 is (has its terminals) opened to electrically disconnect the positive output of the power supply 50 and the power feeding terminal 21. Simultaneously, the relay contact pair 293 is (has its terminals) opened to electrically disconnect the negative output of the power supply 50 and the power feeding terminal 22.

Thus, the power supply 50 and the power feeding terminals 21 and 22 are electrically connected or disconnected in conjunction with the movement of the switch member 25.

According to this embodiment as well, the power supply 50 and the power feeding terminals 21 and 22 are electrically connected or disconnected using the relay 29. Accordingly, it is possible to further increase safety.

According to this embodiment, the relay 29 is provided inside the body of the power-supply-side connector 20B. Alternatively, the relay 29 may be provided outside the body of the power-supply-side connector 20B.

The connector unit according to this embodiment may be used in the electric power supply system described in the first embodiment.

The present invention is not limited to the specifically disclosed embodiments, and variations and modifications may be made without departing from the scope of the present application.

The present application is based upon and claims the benefit of priority of Japanese Patent Application No. 2010-035345, filed on Feb. 19, 2010, the entire contents of which are incorporated herein by reference.

DESCRIPTION OF THE REFERENCE NUMERALS

10 apparatus-side connector
10*a* housing
11 power receiving terminal (+)
12 power receiving terminal (−)
13 grounding terminal
14 projecting part
20 power-supply-side connector
21 power feeding terminal (+)
22 power feeding terminal (−)
23 grounding terminal
24 recess
25 switch member
27 relay
271 coil
272 relay contact pair
28 relay
281 coil
282 relay contact pair
29 relay
291 coil
292 relay contact pair
293 relay contact pair
31 internal contact pair
32 internal contact pair
40 electrical apparatus
50 power supply
60 opening and closing mechanism
61 movable member
611 end part
62 intermediate member
63 link member
64 helical torsion coil spring (elastic member)
70 controlling mechanism
71 movable member
711 button part
72 urging member
80 restricting mechanism
81 engaging hole
82 engaging hole

The invention claimed is:

1. A connector unit, comprising:

a first connector configured to be connected to an electrical apparatus, the first connector including a plurality of power receiving terminals for receiving a supply of electric power; and a second connector configured to be connected to a direct-current power supply and mated with the first connector, the second connector including a plurality of power feeding terminals corresponding to the power receiving terminals of the first connector; and a switch member configured to be moved between a connecting position for electrically connecting the power feeding terminals and the direct-current power supply and a breaking position for breaking a connection of the power feeding terminals and the direct-current power supply.

2. A connector unit, comprising:

a first connector configured to be connected to an electrical apparatus, the first connector including a plurality of power receiving terminals for receiving a supply of electric power; and a second connector configured to be connected to a power supply and mated with the first connector, the second connector including a plurality of power feeding terminals corresponding to the power receiving terminals of the first connector;

a switch member configured to be moved between a connecting position for electrically connecting the power feeding terminals and the power supply and a breaking position for breaking a connection of the power feeding terminals and the power supply; and a controlling mechanism configured to prevent a movement of the switch member from the breaking position to the connecting position before a mating of the first connector and the second connector.

3. The connector unit as claimed in claim 2, wherein the controlling mechanism is configured to allow the movement of the switch member from the breaking position to the connecting position after the mating of the first connector and the second connector.

4. The connector unit as claimed in claim 3, wherein:

the controlling mechanism comprises a movable member configured to be moved between an entering position at which to enter a movement path of the switch member and a retreat position outside the movement path of the switch member, the movable member being urged to the entering position from the retreat position, and the movable member is configured to be moved from the entering position to the retreat position by being pushed by the first connector in the mating of the first connector and the second connector.

5. The connector unit as claimed in claim 4, wherein:

a housing of the first connector includes a projecting part, a housing of the second connector includes a recess configured to be fit to the projecting part, the movable member includes a button part configured to project and retract relative to an inner wall surface of the recess, and the movable member is configured to be moved from the entering position to the retreat position by a movement of the button part into a retraction direction caused by the projecting part pushing the button part in a fitting of the projecting part and the recess.

6. The connector unit as claimed in claim 2, further comprising:

a restricting mechanism configured to prevent a separation of the first connector and the second connector in response to the movement of the switch member from the breaking position to the connecting position with the first connector and the second connector being mated.

7. The connector unit as claimed in claim 6, wherein:

the restricting mechanism includes an engaging hole provided in a housing of the first connector in a direction perpendicular to a mating direction; and a movable member linked to the switch member via a link member, and the movable member is configured to have an end part thereof inserted into the engaging hole in response to the movement of the switch member from the breaking position to the connecting position with the first connector and the second connector being mated.

8. The connector unit as claimed in claim 2, wherein the second connector further includes an internal contact pair configured to be closed to electrically connect the power supply and the power feeding terminals in response to the movement of the switch member from the breaking position to the connecting position.

9. The connector unit as claimed in claim 8, wherein:

the internal contact pair includes a plurality of terminals configured to come into contact with and be separated from each other, and a first one of the terminals is urged in a direction away from a second one of the terminals.

10. The connector unit as claimed in claim 8, wherein the second connector further includes a relay configured to operate to electrically connect the power supply and the power feeding terminals in response to a closure of the internal contact pair.

11. The connector unit as claimed in claim 2, wherein:

the second connector further includes an elastic member configured to be deformed and restored by movements of the switch member, the elastic member being most deformed in response to the switch member being in a predetermined position between the connecting position and the breaking position, and the switch member is configured to move from the predetermined position to one of the connecting position and the breaking position with a restoring force of the elastic member.

12. The connector unit as claimed in claim 2, wherein:

the first connector further includes a first grounding terminal, the second connector further includes a second grounding terminal corresponding to the first grounding terminal, and the first grounding terminal and the second grounding terminal are configured to be fit together with the first connector and the second connector being mated.

13. The connector unit as claimed in claim 2, wherein the electric power supplied by the power supply is direct current.

14. The connector unit as claimed in claim 2, wherein a voltage of the electric power supplied by the power supply is higher than or equal to 48 V.

15. A connector configured to be connected to a power supply and mated with an apparatus-side connector configured to be connected to an electrical apparatus, the connector comprising:

a plurality of power feeding terminals corresponding to a plurality of power receiving terminals of the apparatus-side connector for receiving a supply of electric power; and a switch member configured to be moved between a connecting position for electrically connecting the power feeding terminals and the power supply and a breaking position for breaking a connection of the power feeding terminals and the power supply, wherein the power supply is a direct-current power supply.

16. A connector configured to be connected to a power supply and mated with an apparatus-side connector configured to be connected to an electrical apparatus, the connector comprising:

a plurality of power feeding terminals corresponding to a plurality of power receiving terminals of the apparatus-side connector for receiving a supply of electric power;

a switch member configured to be moved between a connecting position for electrically connecting the power feeding terminals and the power supply and a breaking position for breaking a connection of the power feeding terminals and the power supply; and a controlling mechanism configured to prevent a movement of the switch member from the breaking position to the connecting position before a mating of the connector and the apparatus-side connector.

17. The connector as claimed in claim 16, wherein the controlling mechanism is configured to allow the movement of the switch member from the breaking position to the connecting position after the mating of the connector and the apparatus-side connector.

18. The connector as claimed in claim 17, wherein:

the controlling mechanism comprises a movable member configured to be moved between an entering position at which to enter a movement path of the switch member and a retreat position outside the movement path of the switch member, the movable member being urged to the entering position from the retreat position, and the movable member is configured to be moved from the entering position to the retreat position by being pushed by the apparatus-side connector in the mating of the connector and the apparatus-side connector.

19. The connector as claimed in claim 18, further comprising:

a housing including a recess configured to be fit to a projecting part of a housing of the apparatus-side connector, wherein:

the movable member includes a button part configured to project and retract relative to an inner wall surface of the recess, and the movable member is configured to be moved from the entering position to the retreat position by a movement of the button part into a retraction direction caused by the projecting part pushing the button part in a fitting of the projecting part and the recess.

20. The connector as claimed in claim 16, further comprising:

a movable member linked to the switch member via a link member, wherein the movable member is configured to have an end part thereof inserted into an engaging hole provided in a housing of the apparatus-side connector in a direction perpendicular to a mating direction, in response to the movement of the switch member from the breaking position to the connecting position with the connector and the apparatus-side connector being mated.

21. The connector as claimed in claim 16, further comprising:

an internal contact pair configured to be closed to electrically connect the power supply and the power feeding terminals in response to the movement of the switch member from the breaking position to the connecting position.

22. The connector as claimed in claim 21, wherein:

the internal contact pair includes a plurality of terminals configured to come into contact with and be separated from each other, and a first one of the terminals is urged in a direction away from a second one of the terminals.

23. The connector as claimed in claim 21, further comprising:

a relay configured to operate to electrically connect the power supply and the power feeding terminals in response to a closure of the internal contact pair.

24. The connector as claimed in claim 16, further comprising:

an elastic member configured to be deformed and restored by movements of the switch member, the elastic member being most deformed in response to the switch member being in a predetermined position between the connecting position and the breaking position, wherein the switch member is configured to move from the predetermined position to one of the connecting position and the breaking position with a restoring force of the elastic member.

25. The connector as claimed in claim 16, further comprising:

a grounding terminal corresponding to a grounding terminal of the apparatus-side connector, the grounding terminal being configured to fit to the grounding terminal of the apparatus-side connector with the connector and the apparatus-side connector being mated.

26. The connector as claimed in claim 16, wherein the electric power supplied by the power supply is direct current.

27. The connector as claimed in claim 16, wherein a voltage of the electric power supplied by the power supply is higher than or equal to 48 V.

* * * * *